US009504317B1

(12) United States Patent
White et al.

(10) Patent No.: US 9,504,317 B1
(45) Date of Patent: Nov. 29, 2016

(54) TABLE CONSTRUCTION

(71) Applicant: Steelcase Inc., Grand Rapids, MI (US)

(72) Inventors: Justin M. White, Caledonia, MI (US); David C. Eberlein, Hudsonville, MI (US); Mohd Ramdan Rohani, Selangor (MY); Jesse M. Menayan, Sausalito, CA (US)

(73) Assignee: Steelcase Inc., Grand Rapids, MI (US)

( * ) Notice: Subject to any disclaimer, the term of this patent is extended or adjusted under 35 U.S.C. 154(b) by 0 days.

(21) Appl. No.: 14/722,989

(22) Filed: May 27, 2015

(51) Int. Cl.

| | |
|---|---|
| ***A47B 37/00*** | (2006.01) |
| ***A47B 21/06*** | (2006.01) |
| ***A47B 21/02*** | (2006.01) |
| ***A47B 9/04*** | (2006.01) |
| ***A47B 9/20*** | (2006.01) |

(52) U.S. Cl.
CPC ..... *A47B 21/06* (2013.01); *A47B 9/04* (2013.01); *A47B 9/20* (2013.01); *A47B 21/02* (2013.01)

(58) Field of Classification Search
CPC ..... A47B 21/06
USPC ..... 108/50.01, 50.02, 108, 153.1; 248/188.4; 312/195, 206, 223.1, 223.3, 312/223.6, 257.1, 265.1, 265.2
See application file for complete search history.

(56) References Cited

U.S. PATENT DOCUMENTS

| | | | |
|---|---|---|---|
| 102,413 | A | 4/1870 | Luther |
| 239,556 | A | 3/1881 | Faber et al. |
| 269,365 | A | 12/1882 | Wood |
| 472,347 | A | 4/1892 | Gibbs |
| 538,674 | A | 5/1895 | Rexing |
| 611,260 | A | 9/1898 | Olandi |
| 1,030,658 | A | 6/1912 | Gregory |
| 1,125,668 | A | 12/1914 | Deming |
| 1,123,959 | A | 1/1915 | Von Der Lin et al. |
| 1,123,960 | A | 1/1915 | Von Der Lin et al. |
| 1,435,606 | A | 11/1922 | Henry |
| 1,528,287 | A | 3/1925 | Vincent |
| 1,849,835 | A | 3/1932 | Jantzen et al. |
| 1,898,465 | A | 2/1933 | Peters |
| 1,973,948 | A | 12/1933 | Fredrik |
| 2,783,583 | A | 3/1957 | Holmquist |
| 3,104,493 | A | 9/1963 | Nalle |
| 3,131,505 | A | 5/1964 | Cruikshank |
| 5,116,004 | A | 5/1992 | Luecke |
| 5,142,734 | A | 9/1992 | Looman et al. |
| 5,715,761 | A | 2/1998 | Frattini |
| 5,881,979 | A | 3/1999 | Rozier, Jr. et al. |

(Continued)

FOREIGN PATENT DOCUMENTS

| | | |
|---|---|---|
| DE | 9416757 | 1/1995 |
| DE | 29614294 | 11/1996 |
| JP | 2011092441 | 5/2011 |

*Primary Examiner* — Matthew Ing
(74) *Attorney, Agent, or Firm* — Price Heneveld LLP

(57) ABSTRACT

A leg assembly for a table comprises an elongated body portion having a wireway extending along a length of the body portion and configured to receive electrical power and communication lines therein, one or more wire retaining assemblies located within the wireway of the body portion, each of the one or more wire retaining assemblies movable between a first position, wherein electrical power and communication lines are retained within the wireway, and a second position, wherein electrical power and communication lines may be readily removed from within the wireway, and a cover member releasably connected to the one or more wire retaining assemblies.

31 Claims, 43 Drawing Sheets

(56) References Cited

U.S. PATENT DOCUMENTS

| | | | | |
|---|---|---|---|---|
| 5,934,203 | A | 8/1999 | Glass | |
| 6,135,401 | A | 10/2000 | Chen | |
| 6,327,985 | B1 | 12/2001 | Frenkler et al. | |
| 6,354,231 | B1 | 3/2002 | Morris | |
| 6,415,723 | B1 | 7/2002 | Kopish et al. | |
| 6,523,795 | B2 | 2/2003 | Gutgsell et al. | |
| 6,536,725 | B2 | 3/2003 | Fisher | |
| 7,088,577 | B2 * | 8/2006 | Lauffer | G06F 1/1601 361/679.21 |
| 7,159,829 | B1 * | 1/2007 | Finkelstein | B60B 33/04 108/144.11 |
| 7,168,373 | B1 * | 1/2007 | Hock | A47B 91/02 108/147.11 |
| 7,287,732 | B2 | 10/2007 | Balistreri | |
| 7,293,510 | B1 | 11/2007 | Siao | |
| 8,002,224 | B2 | 8/2011 | Hamann | |
| 8,079,314 | B2 | 12/2011 | MacLean et al. | |
| 8,146,514 | B2 | 4/2012 | Hamilton et al. | |
| 8,360,375 | B2 | 1/2013 | Jones | |
| 8,667,908 | B2 | 3/2014 | Martin et al. | |
| 8,714,499 | B2 | 5/2014 | Schwartz et al. | |
| 2006/0096506 | A1 | 5/2006 | Brauning et al. | |
| 2008/0210144 | A1 | 9/2008 | Prendergast | |

* cited by examiner

TABLE CONSTRUCTION

BACKGROUND OF THE INVENTION

The present invention relates to a table construction, and in particular, to a table construction having a support arrangement that includes longitudinally adjustable leg members.

BRIEF SUMMARY OF THE INVENTION

One aspect of the present invention is a leg assembly for a table that includes an elongated body portion having a wireway extending along a length of the body portion and configured to receive electrical power and communication lines therein, one or more wire retaining assemblies located within the wireway of the body portion, each of the one or more wire retaining assemblies located within the wireway of the body position, each of one or more wire retaining assemblies movable between a first portion, wherein electrical power and communication lines are retained within the wireway, and a second position, wherein electrical power and communication lines may be readily removed from within the wireway, and a cover member releasably connected to the one or more wire retaining assemblies.

Another aspect of the present invention is a leg assembly for a table that includes a body portion having a first end and a second end, the second end having a cross-sectional configuration, a base member assembly configured to abut a floor surface and having an outer cross-sectional configuration substantially similar to the outer cross-sectional configuration of the second end of the body member, and an adjustment mechanism coupling the base member to the second end of the body portion, such that pivoting the base member with respect to the body member increases or decreases a length of the leg assembly.

Yet another aspect of the present invention is a leg assembly for a table the includes a body portion having an upper end and a lower end, a base member assembly adjustably coupled to the lower end of the body portion and configured to abut a floor surface, wherein the adjustment of the base member assembly increases or decreases a length of the leg assembly, a wireway extending longitudinally along an interior of the body portion and configured for routing electrical power and communication lines therethrough, and a cover member releasably connected to the body portion so as to cover the wireway.

Still yet another aspect of the present invention is a leg assembly for a table that includes a body portion having a first end and a second end, a base member assembly configured to abut a floor surface, and an adjustment mechanism coupling the base member to the second end of the body portion such that a distance between the base member and the body portion may be adjusted thereby adjusting a length of the leg assembly. The adjustment assembly includes at least one collar member extending between the body portion and the base member and is configured to cover at least a portion of a gap formed between the base portion and the body portion as the distance between the base portion and the body portion increases, and wherein the collar member includes a visual indicator configured to provide a visual indication of the amount of adjustment between the base member and the body portion so as to prevent an operator from exceeding a predetermined amount of adjustment.

These and other features, advantages, and objects of the present invention will be further understood and appreciated by those skilled in the art by reference to the following specification, claims, and appended drawings.

DETAILED DESCRIPTION OF THE PREFERRED EMBODIMENTS

Figure 1:
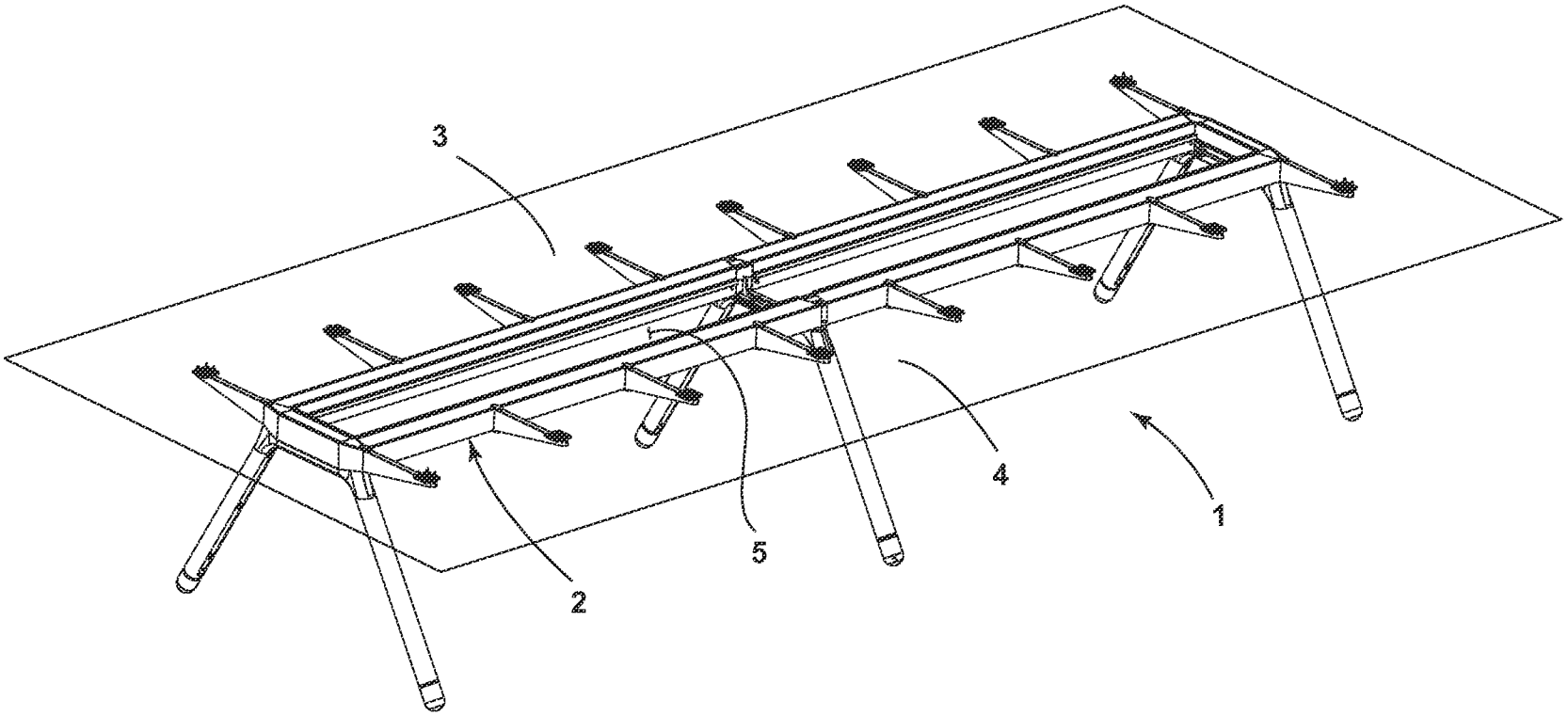
FIG. 1 is a perspective view of table construction having a support system embodying a leg assembly of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIG. 1) generally designates a table assembly of the present invention that includes a frame 2 which supports two or more elongate worksurfaces 3, 4 on opposite sides of the table 1. Although the illustrated example includes two worksurfaces 3, 4, it is noted that certain aspects of the present invention may also be utilized with a single worksurface. Each worksurface 3, 4 is of sufficient length to form multiple workstations arranged in a side-by-side relationship, which can be accessed anywhere along the outer edges of worksurfaces 3, 4. The worksurfaces 3, 4 can be unitary members or sectioned members as needed. The table assembly may also include wire management panels that are configured to be supported near the interior edges of the worksurfaces 3, 4 at a centrally disposed elongate open window 5 defined by the frame 2. The wire management panels, or troughs, are used to route cable, data, power and the like to the different workstations along the length of the table 1. Preferably, the wire management panels 7 are constructed of a metal such as steel, however, other materials may also be utilized, such as other metals, wood, fabrics and knits, and the like, or some combination thereof.

Figure 2:
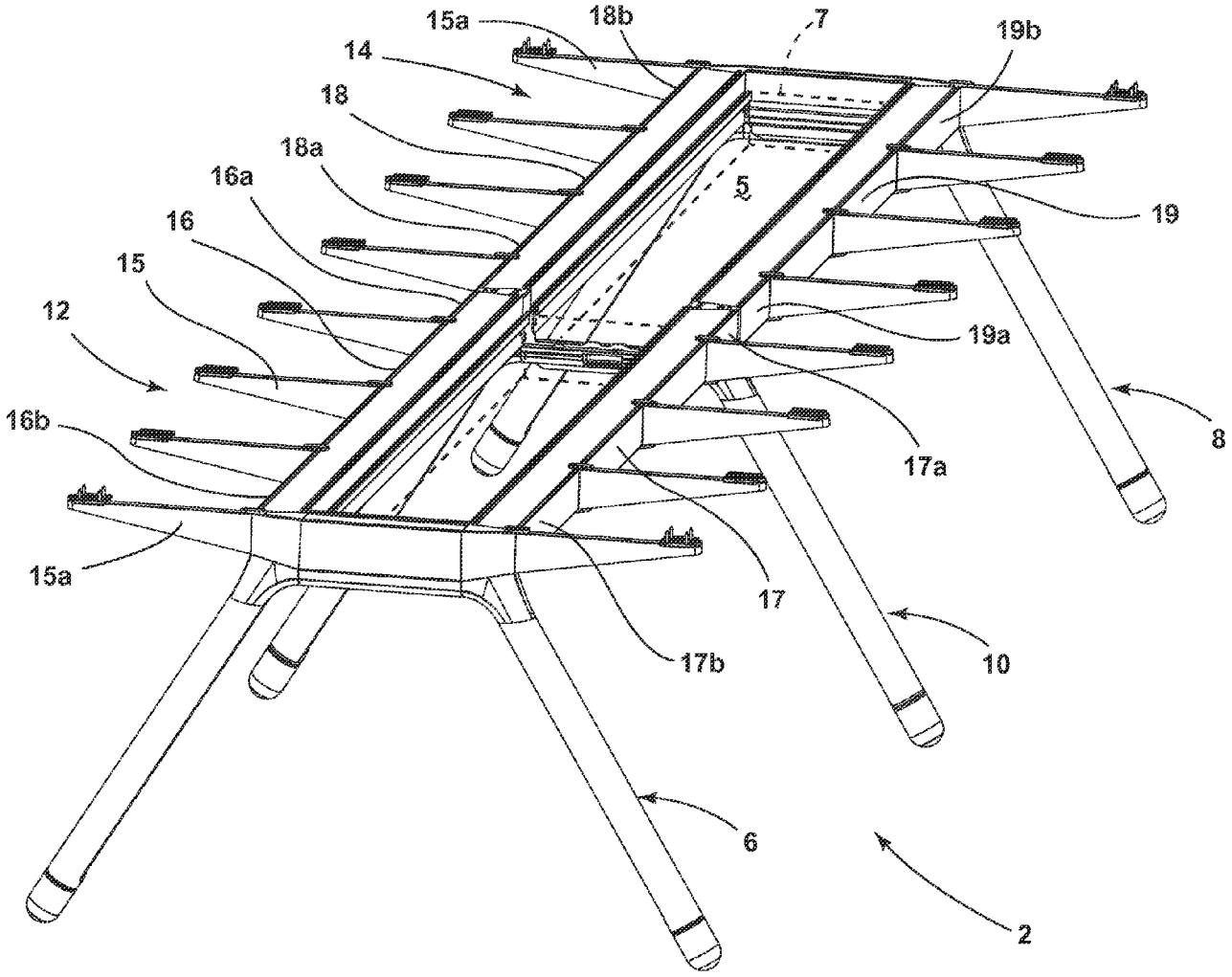
FIG. 2 is a perspective view of a table frame.

The illustrated frame 2 (FIG. 2) includes a support arrangement including a pair of end leg assemblies 6, 8, and a center leg assembly 10. It is contemplated that the frame 2 may include any plurality of leg assemblies as needed to support the table 1. The end leg assemblies 6, 8 are interconnected at opposite ends of first and second sets 12, 14 of parallel, elongate hollow beams 16, 17, 18, 19, wherein the beams 16, 17 define the first set of beams 12, and the beams 18, 19 define the second set of the beams 14. Multiple sets of beams 12, 14 and leg assemblies may be used to provide a table with an extended length. The beams 16-19 of the first and second sets of beams 12, 14 are spaced laterally apart a predetermined distance and are generally parallel with one another along the length of the table 1 to define the elongate open window 5 in conjunction with the end leg assemblies 6, 8. As shown in FIG. 2, the beam 16 and the beam 18 are interconnected and linearly aligned. Similarly, the beam 17 and the beam 19 are interconnected and linearly aligned. Innermost ends 16*a*-19*a* of the beams 16-19, respectively, are coupled to the center leg assembly 10, as further described below. Outermost ends 16*b*-19*b* of the beams 16-19, respectively, are coupled to one of the associated end leg assemblies 6, 8, as further described below. A plurality of cantilevered support brackets 15 are coupled to the frame 2 along outer surfaces of the beams 16-19, and the worksurfaces 3, 4 (FIG. 1). End brackets 15*a* are similar to the top support brackets 15, and are coupled to the end leg assemblies 6, 8 for further supporting the worksurfaces 3, 4. The end leg assemblies 6, 8 are substantially identical in configuration to one another, and will be described below with reference to end leg assembly 6 shown in FIG. 3.

Figure 3:
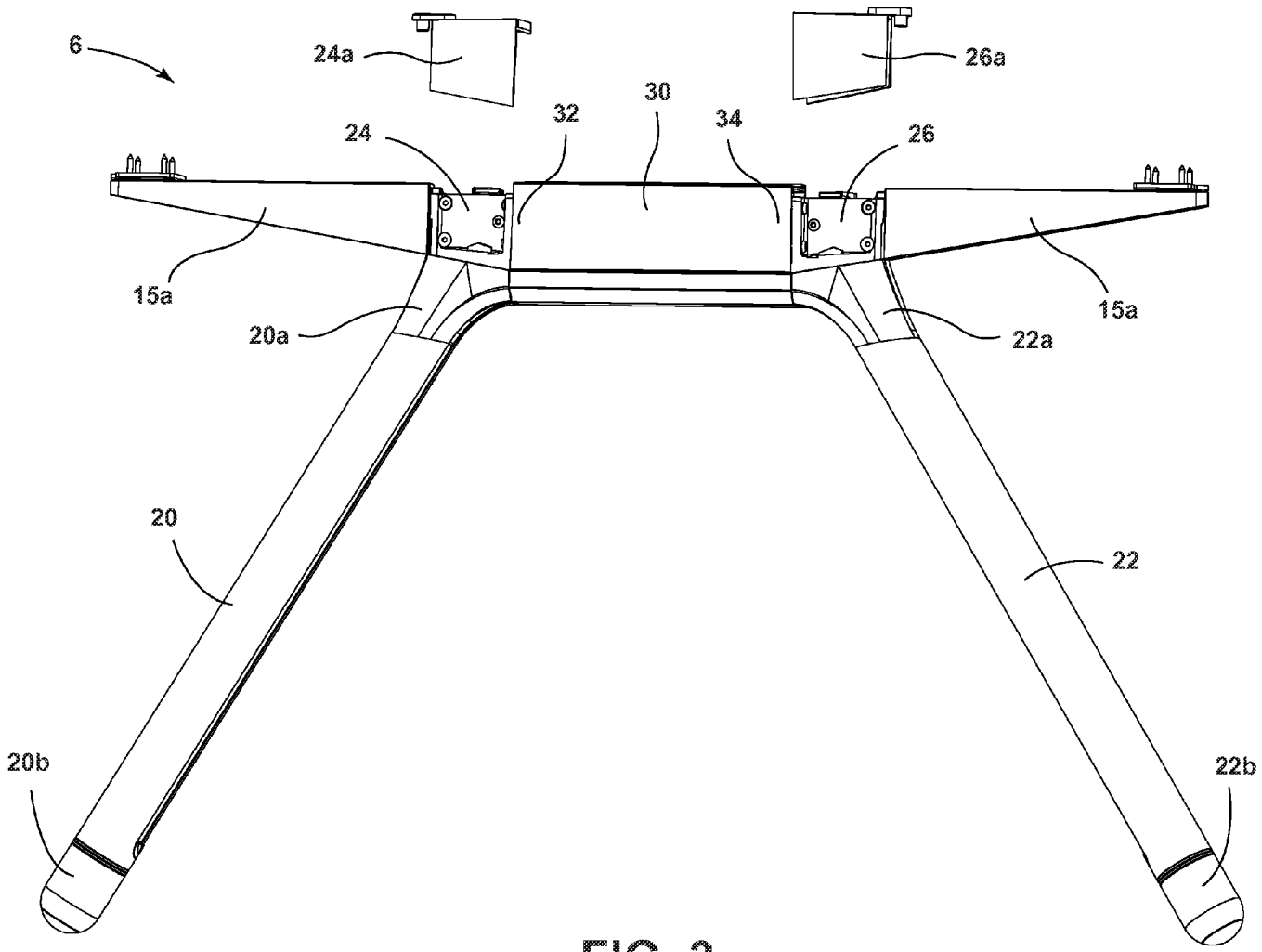
FIG. 3 is an exploded perspective view of an end leg assembly.

The end leg assembly 6 (FIG. 3) includes a pair of opposed first and second legs 20, 22. In the illustrated example, the first and second legs 20, 22 comprise cast aluminum members having adjustable lower ends 20*b*, 22*b*, respectively, although other materials such as wood, plastics and the like may be utilized. The lower ends 20*b*, 22*b* are adapted for abutting support on an associated floor surface. The first and second legs 20, 22 further include upper ends 20*a*, 22*a*, connected to opposing end support brackets 24, 26 via mechanical fasteners such as screws or bolts (not shown). A horizontal leg beam 30 extends between the pair of first and second legs 20, 22 and includes opposite ends 32, 34 thereof connected with the end support brackets 24, 26 by additional mechanical fasteners. As further shown in FIG. 3, the end supports 15*a* are coupled to the end support brackets 24, 26, and extend outwardly from the first and second legs 20, 22 for supporting a worksurface as noted above. In FIG. 3, a pair of bracket covers 24*a*, 26*a* are shown exploded away from the end support brackets 24, 26, and are used to cover the support brackets 24, 26 in assembly. Each end leg assembly 6, 8 has a generally inverted U-shaped side elevational configuration, and is sufficiently rigid to support the worksurfaces 3, 4 (FIG. 1), as well as any objects placed thereon.

The center leg assembly 10 (FIGS. 4A-4D) is shown having a pair of opposed first and second legs 42, 44. The first and second legs 42, 44, like first and second legs 20, 22 described above, are contemplated to be cast aluminum members, however, other suitable materials may be utilized. The first and second legs 42, 44 each include upper ends 42*a*, 44*a*, which are respectively connected to beam connecting bracket assemblies 50, 52 by fasteners 54, and adjustable lower ends 42*b*, 44*b*, respectively, which are adapted for abutting support from an associated floor surface.

The beam connecting bracket assemblies 50, 52 define linear beam interconnecting bracket assemblies, as further described below. A substantially horizontal trough support bracket 56 couples to and extends between the first and second legs 42, 44 and includes opposite end plates 58, 60. The end plates 58, 60 are operably coupled to the beam connecting bracket assemblies 50, 52 at connecting locations X, which may include welded connections between the component parts. As shown in FIGS. 4A-4D, the center leg assembly 10 has a generally inverted U-shaped side elevational configuration similar to the end leg assemblies 6 and 8 (FIG. 2) described above, thereby giving the table 1 an overall uniform appearance.

Figure 4A:
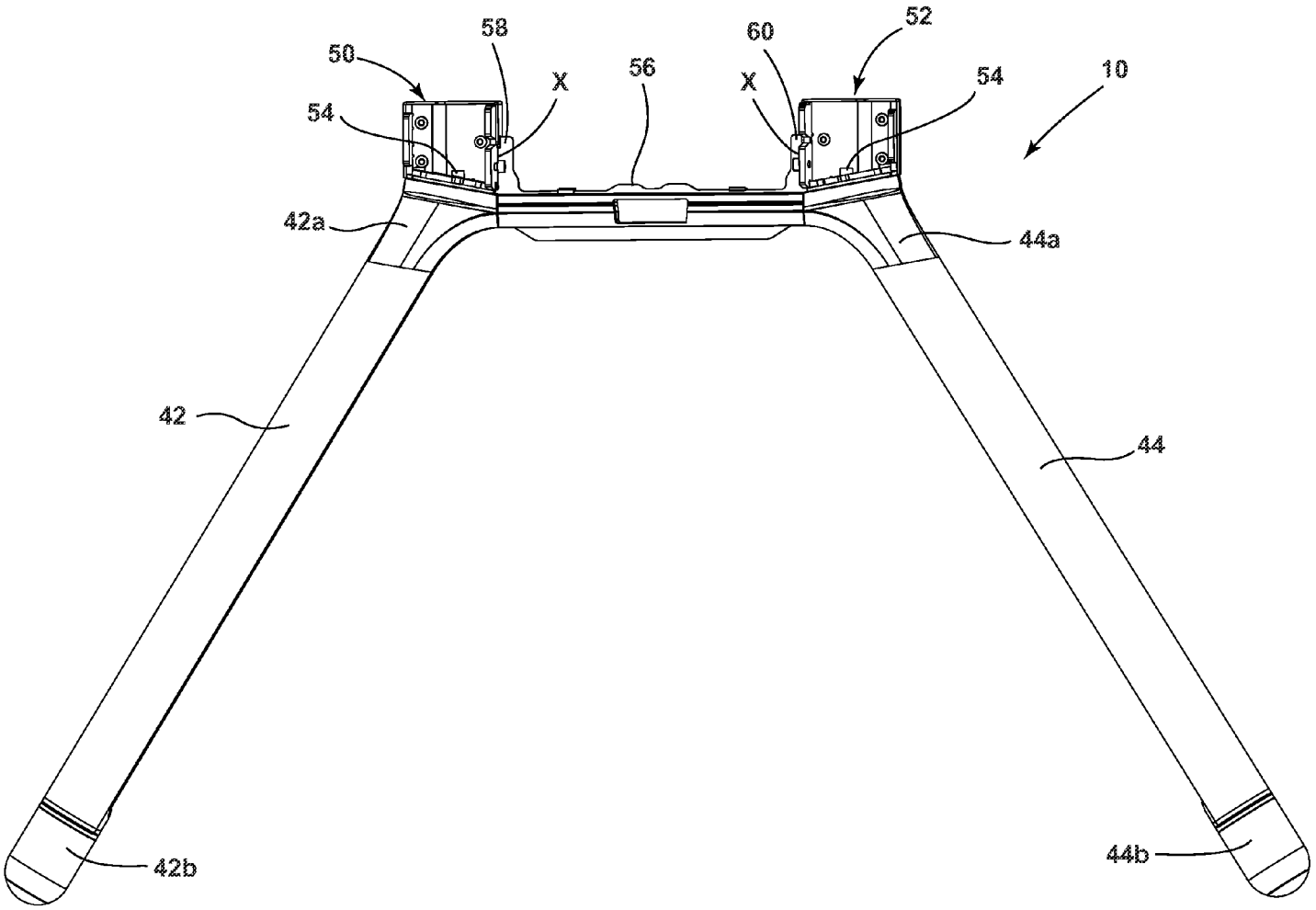
FIG. 4A is a perspective view of a center leg assembly.
Figure 4B:
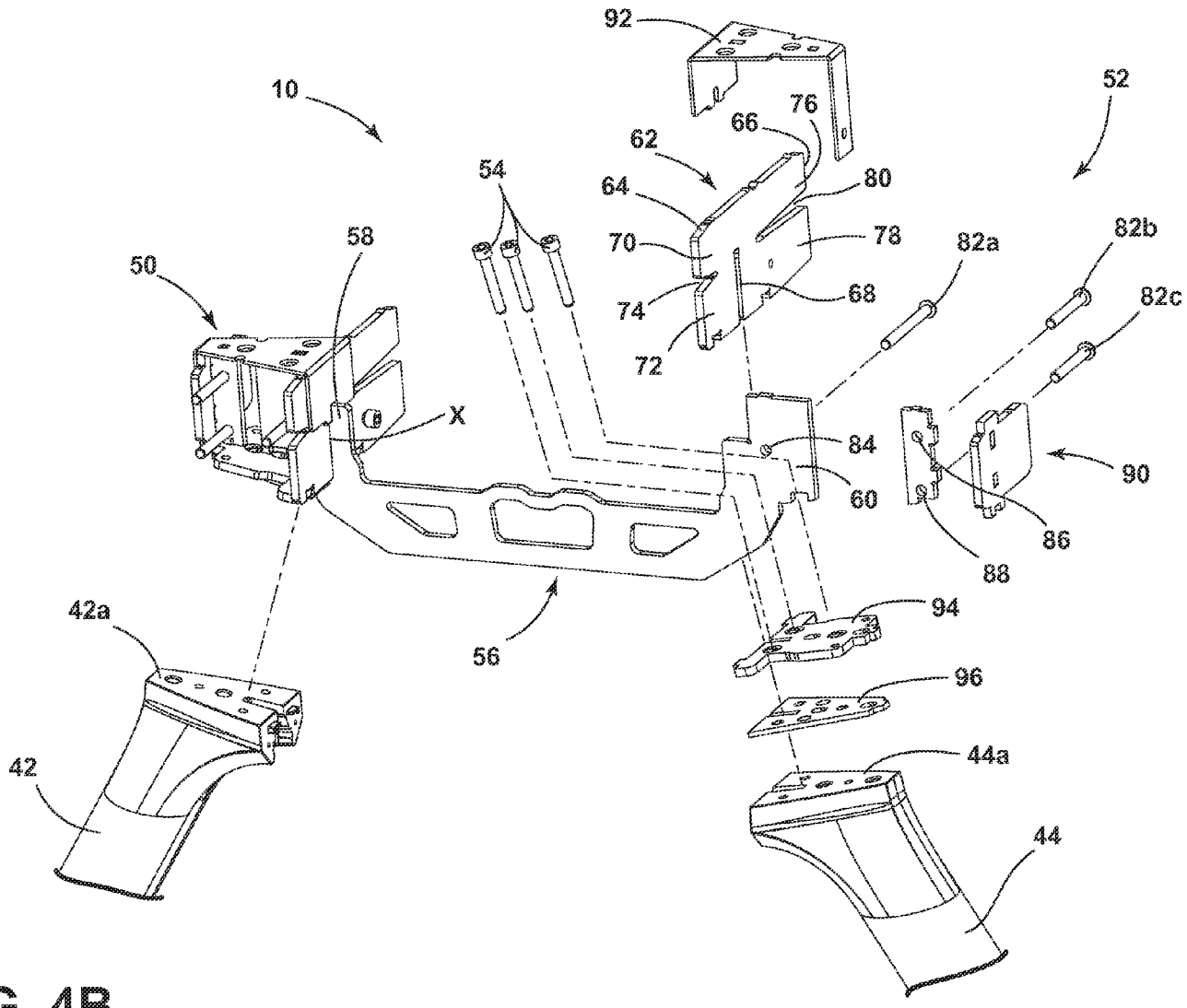
FIG. 4B is an exploded perspective view of an upper portion of the center leg assembly of FIG. 4A.
Figure 4C:
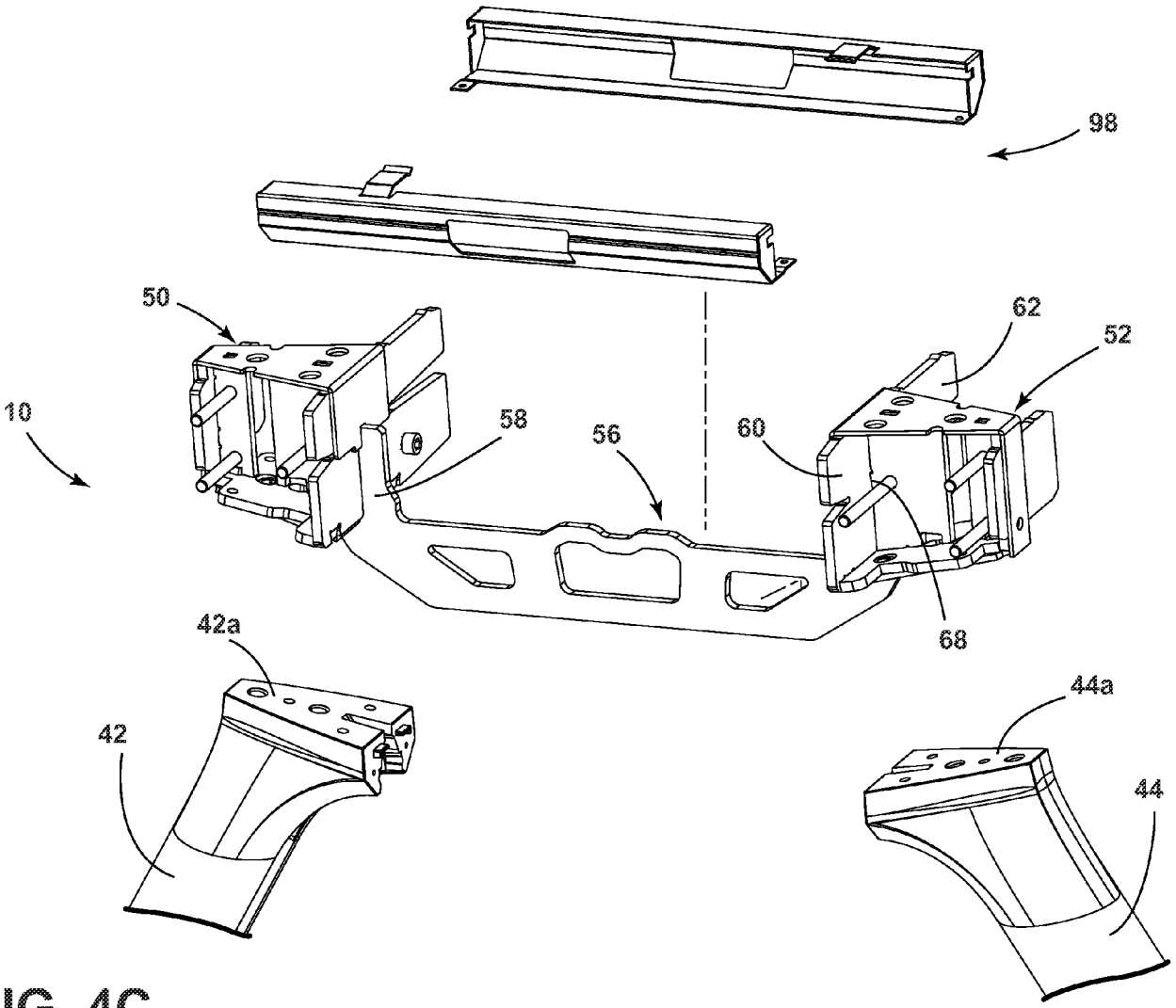
FIG. 4C is an exploded perspective view of an upper portion of the center leg assembly of FIG. 4A.

With specific reference to FIG. 4B, the beam connecting bracket assembly 52 is shown in an exploded view and is considered to be a complimentary mirror image of the beam connecting bracket assembly 50 described above. Thus, for description purposes, the beam connecting bracket assembly 52 will be described in detail below with the beam connecting bracket assembly 50 having corresponding component parts. The beam connecting bracket assembly 52 is shown having a connecting plate 62 separated into first and second sides 64, 66 by a vertical slot 68. The first side 64 includes upper and lower connecting flanges 70, 72 having a wedged slot 74 disposed therebetween. The second side 66 includes upper and lower connecting flanges 76, 78 with a wedged slot 80 disposed therebetween. As shown in FIG. 4B, the upper and lower connecting flanges 76, 78 of the second side 66 of the connecting plate 62 are longer than the upper and lower connecting flanges 70, 72 of the first side 64 of the connecting plate 62. In assembly, the upper and lower connecting flanges 70, 72 are configured to be received in interior compartments of an associated beam, such as the beam 17 shown in FIG. 2. The upper and lower connecting flanges 76, 78 are configured to be received in interior compartments of an associated beam, such as the beam 19 shown in FIG. 5. In this way, the beam 17 is connected to the beam 19 by the connecting plate 62 in a serially aligned linear manner at the innermost ends 17*a*, 19*a* of the beams 17, 19, respectively, as shown in FIG. 2. After the upper and lower connecting flanges 70, 72 of the first side 64 of the connecting plate 62 are received in interior compartments of a corresponding beam, a plurality of fasteners 82*a*-82*c* are mounted to mounting bosses disposed in the interior of the corresponding beam, as further described below with reference to FIG. 5. The connecting plate 62 is further coupled to other components of the beam connecting bracket assembly 52, in assembly, as well as the trough support bracket 56. Specifically, fastener 82*a* passes through a mounting aperture 84 disposed through the end plate 60 of the trough support bracket 56. The fasteners 82*b*, 82*c* pass through mounting apertures 86, 88 disposed in a two-part bracket member 90 of the bracket assembly 52. A bracket cover 92 covers the beam connecting bracket assembly 52 in assembly to provide a finished appearance for the center leg assembly 10. The beam connecting bracket assembly 52 further includes lower plates 94, 96 having mounting apertures disposed there through for connecting the beam connecting bracket assembly 52 to the upper end 44*a* of the leg 44 using the fasteners 54.

Figure 4D:
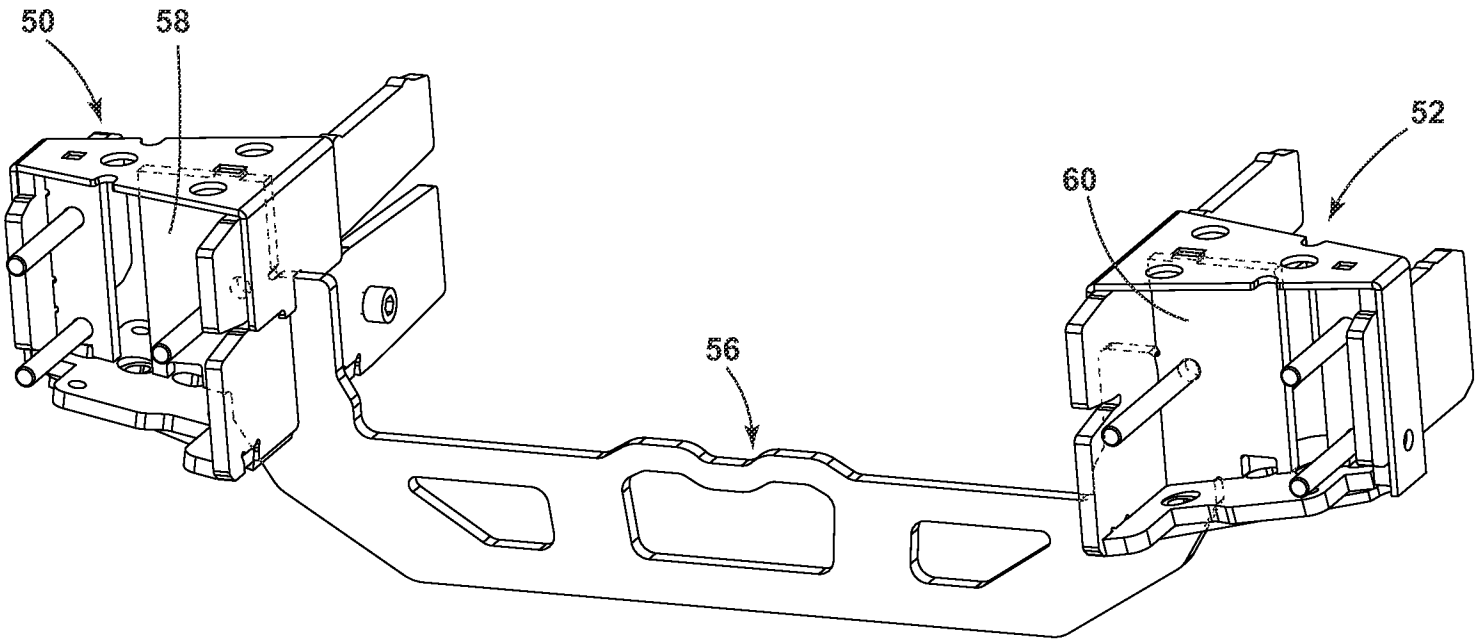
FIG. 4D is a perspective view of a beam connecting assembly.
Figure 48:
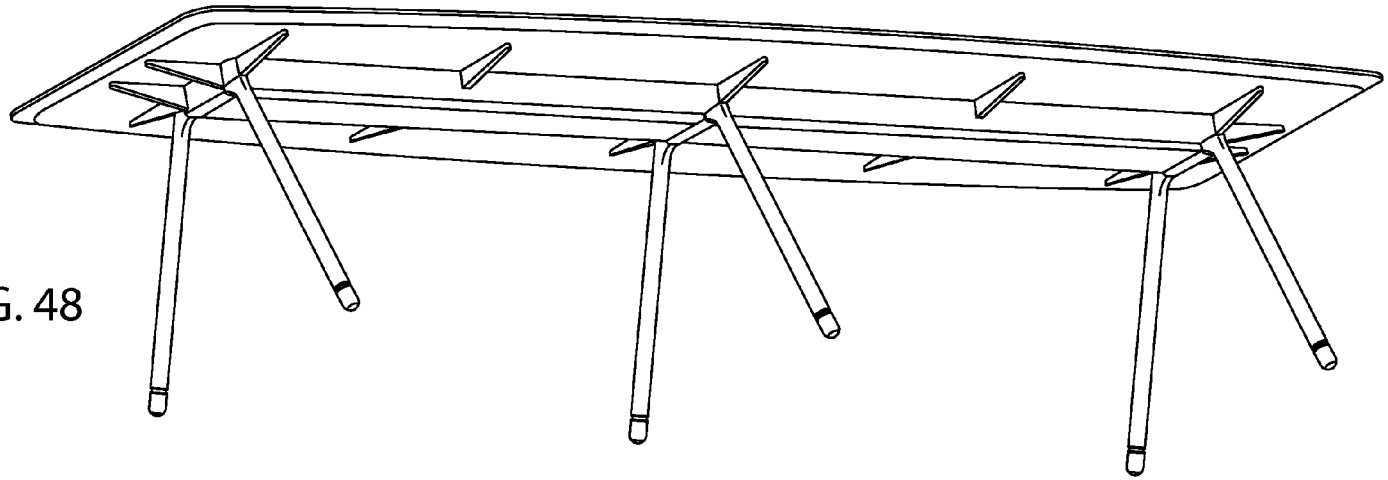
FIG. 48 is a bottom perspective view of the table construction of FIG. 47.
Figure 49:
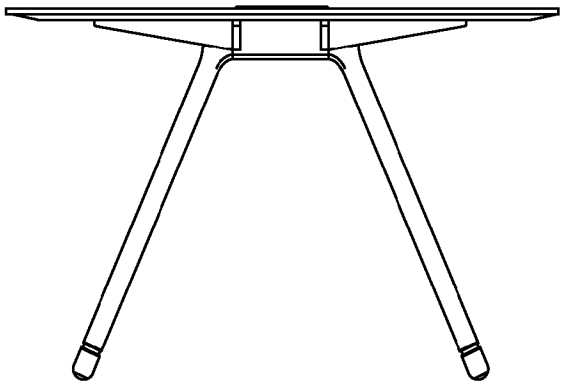
FIG. 49 is an end elevational view of the table construction of FIG. 47.
Figure 50:
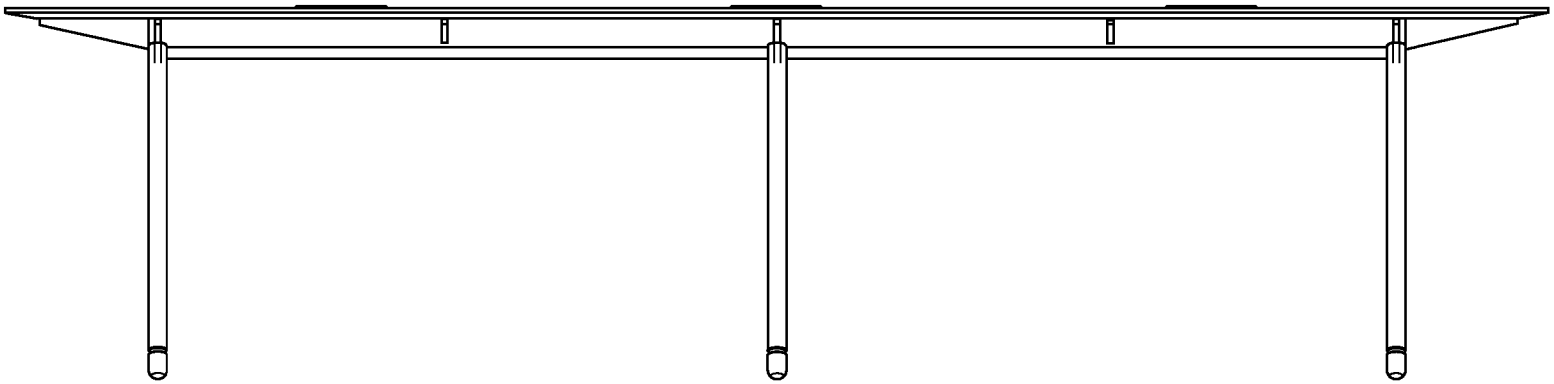
FIG. 50 is a side elevational view of the table construction of FIG. 47.
Figure 51:
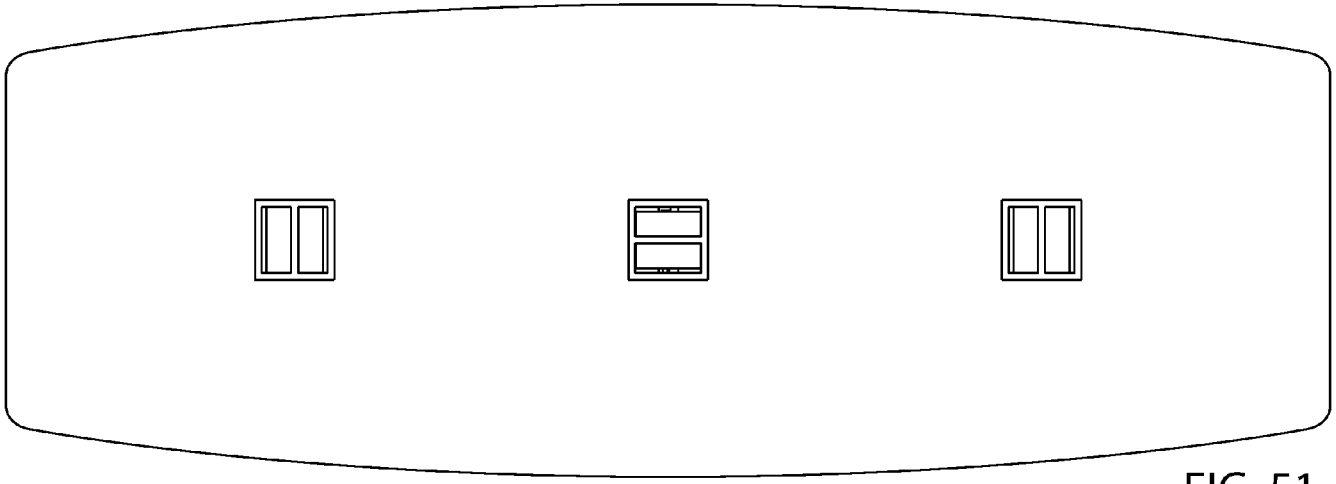
FIG. 51 is a top plan view of the table construction of FIG. 47.
Figure 52:
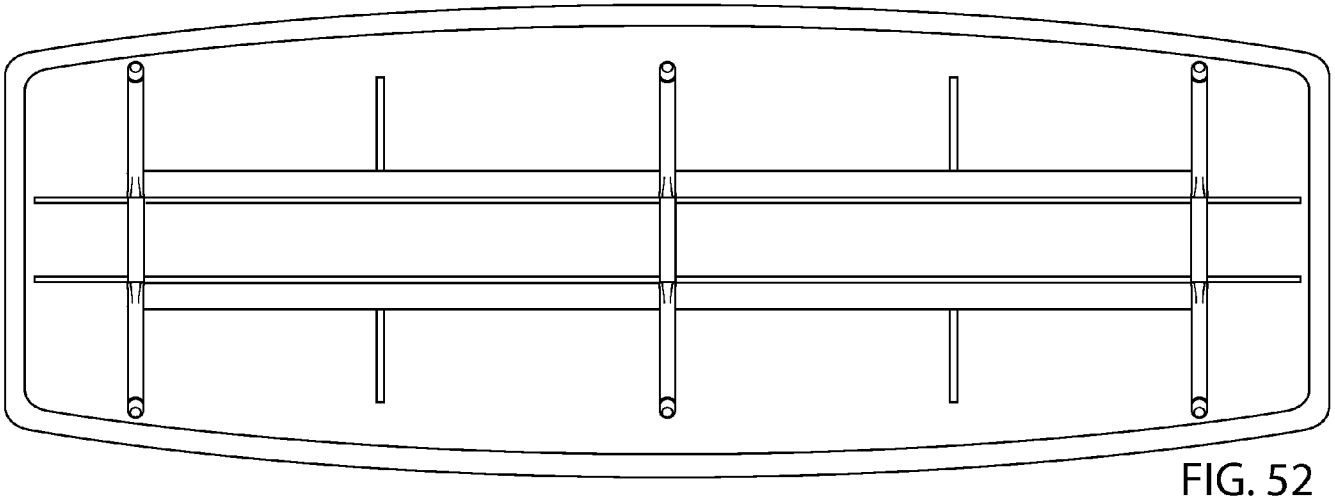
FIG. 52 is a bottom plan view of the table construction of FIG. 47.
Figure 53:
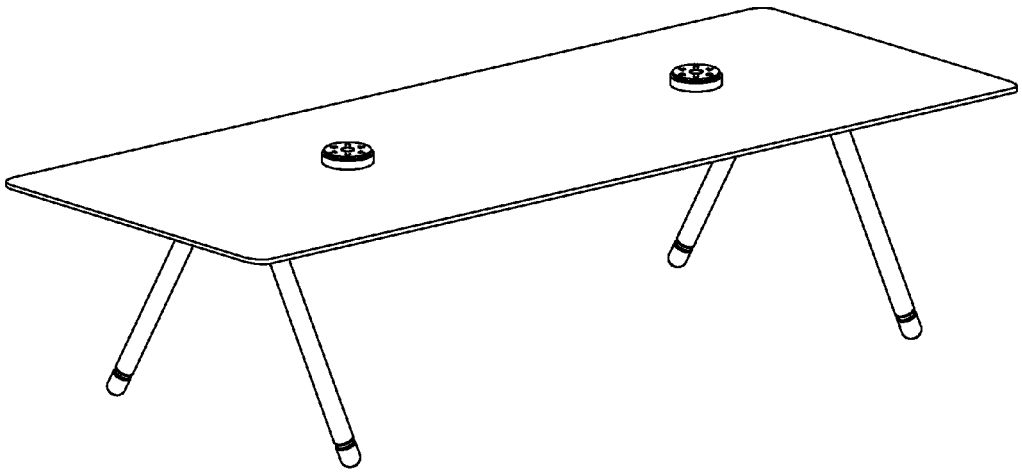
FIG. 53 is a top perspective view of a table construction.
Figure 54:
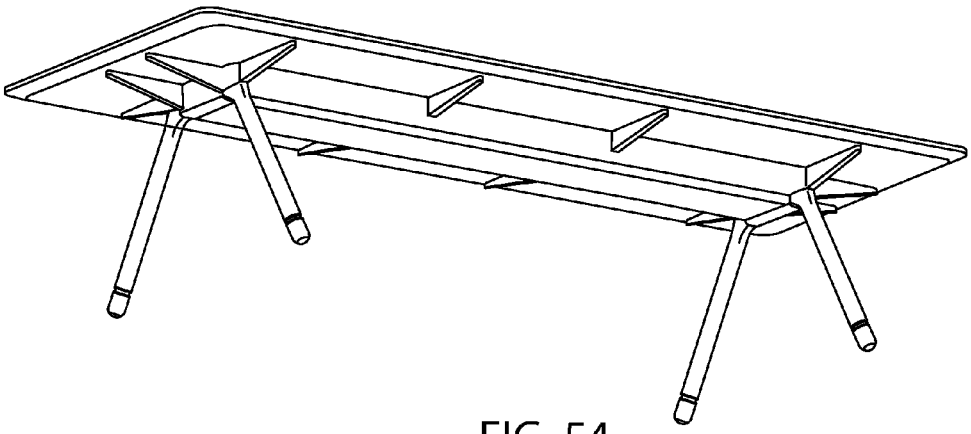
FIG. 54 is a bottom perspective view of the table construction of FIG. 53.
Figure 55:
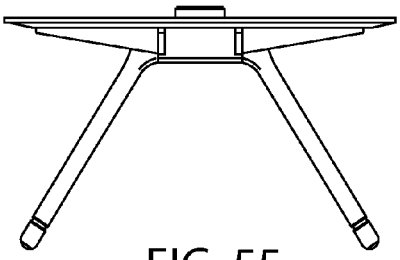
FIG. 55 is an end elevational view of the table construction of FIG. 53.
Figure 56:
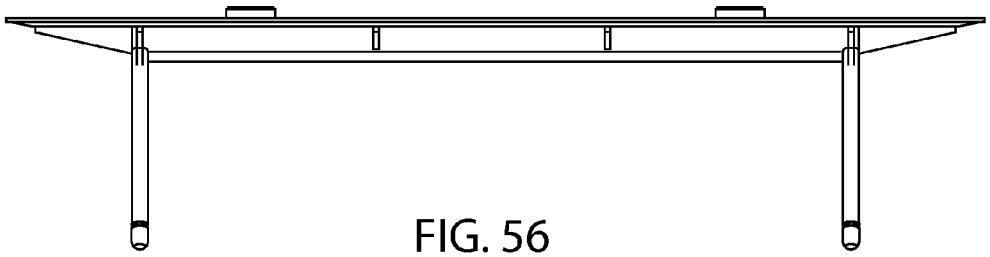
FIG. 56 is a side elevational view of the table construction of FIG. 53.
Figure 57:
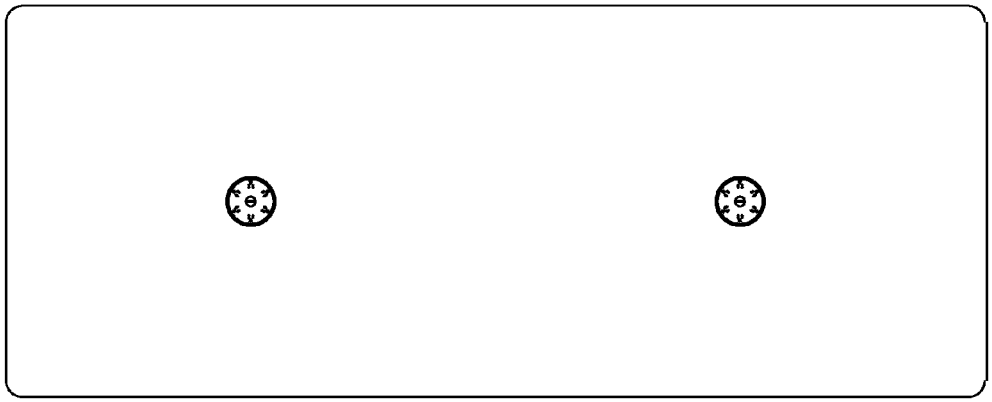
FIG. 57 is a top plan view of the table construction of FIG. 53.
Figure 58:
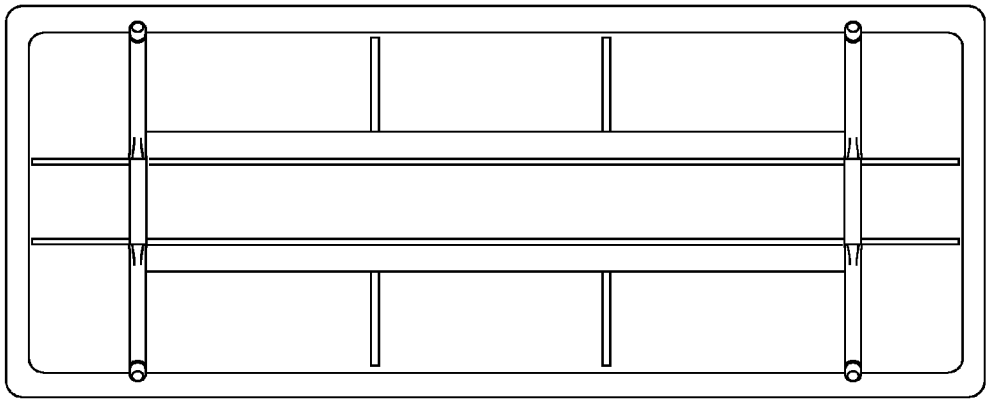
FIG. 58 is a bottom plan view of the table construction of FIG. 53.
Figure 59:
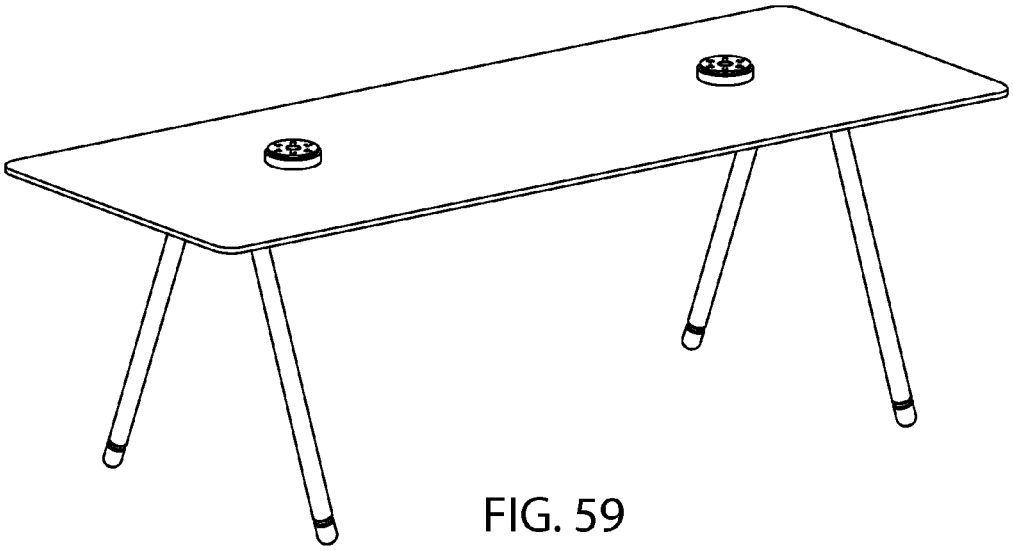
FIG. 59 is a top perspective view of a table construction.
Figure 60:
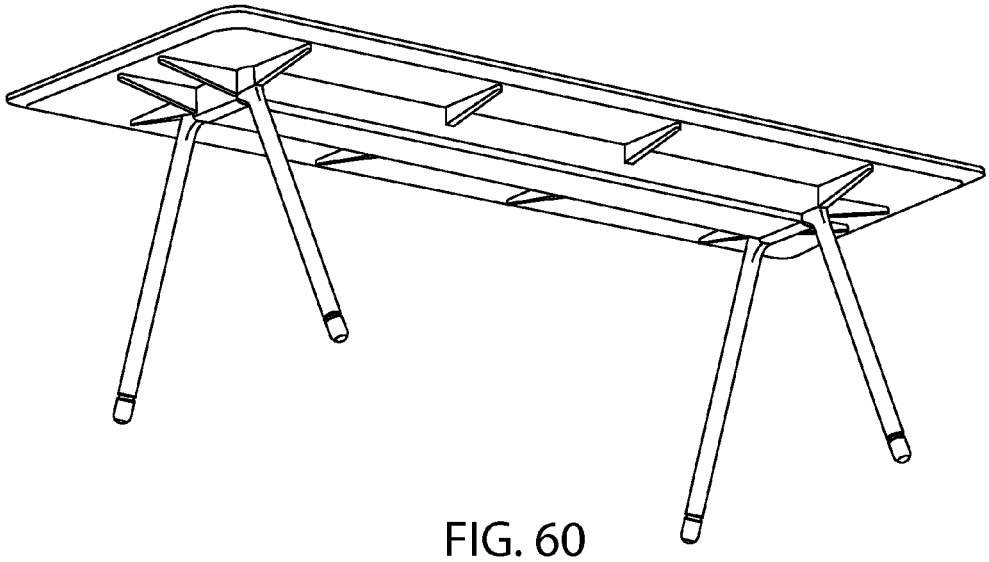
FIG. 60 is a bottom perspective view of the table construction of FIG. 59.
Figure 61:
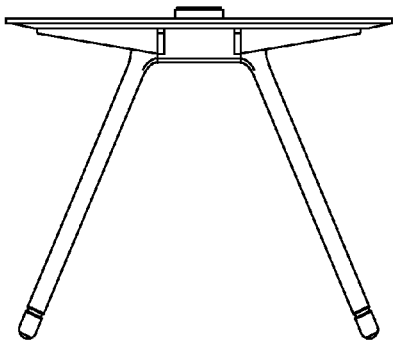
FIG. 61 is an end elevational view of the table construction of FIG. 59.
Figure 62:
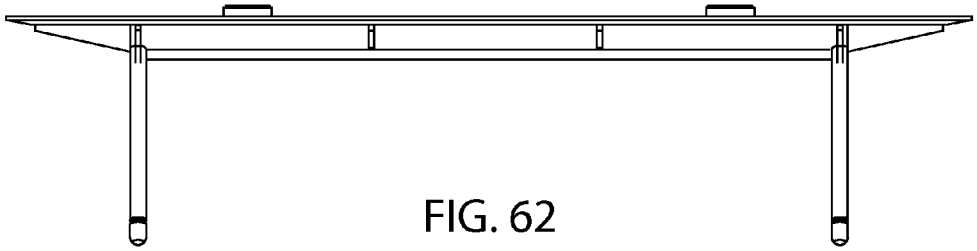
FIG. 62 is a side elevational view of the table construction of FIG. 59.
Figure 63:
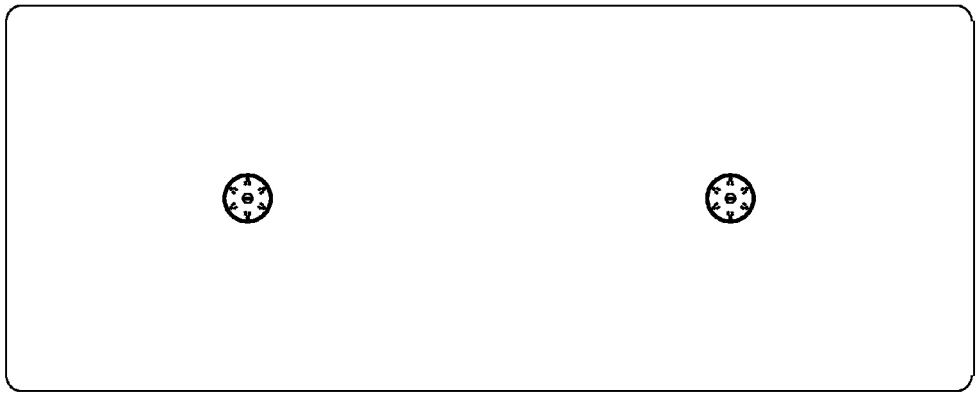
FIG. 63 is a top plan view of the table construction of FIG. 59.
Figure 64:
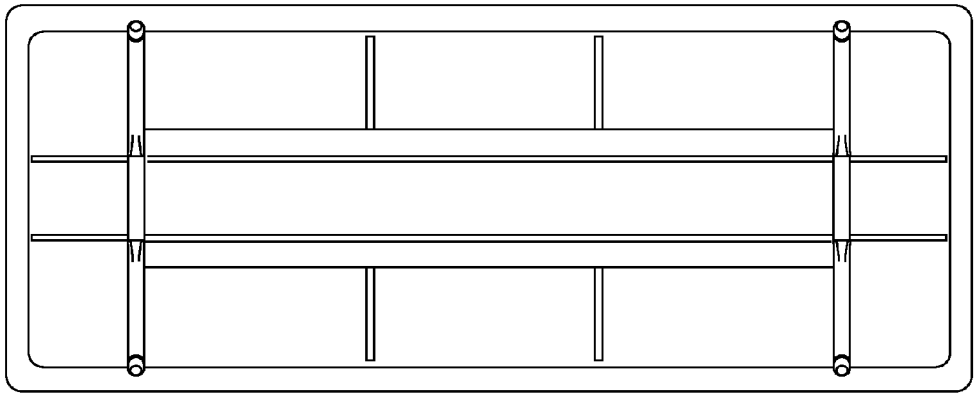
FIG. 64 is a bottom plan view of the table construction of FIG. 59.
Figure 65:
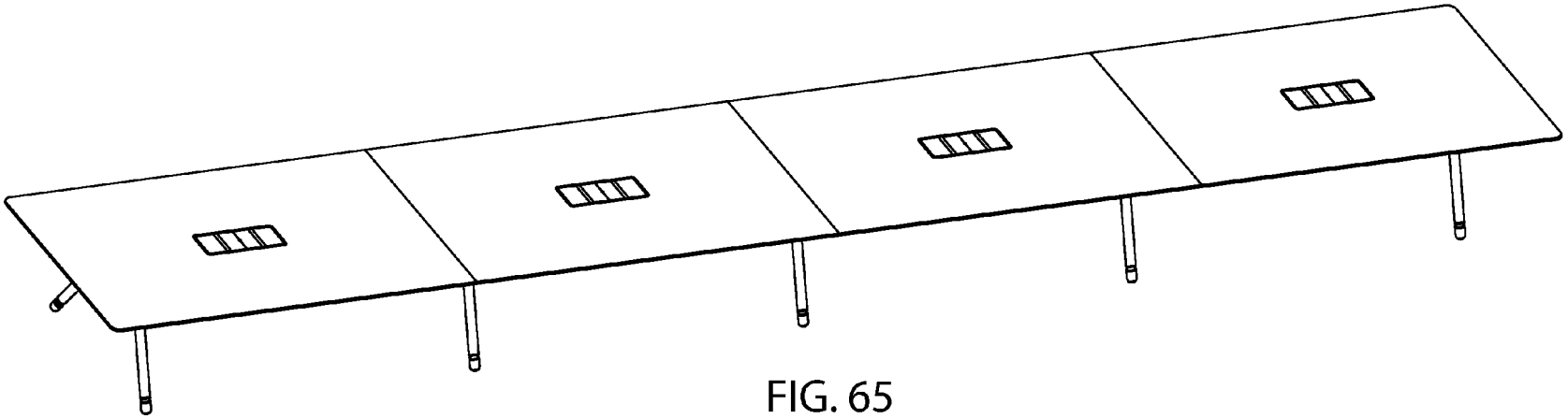
FIG. 65 is a top perspective view of a table construction.
Figure 66:
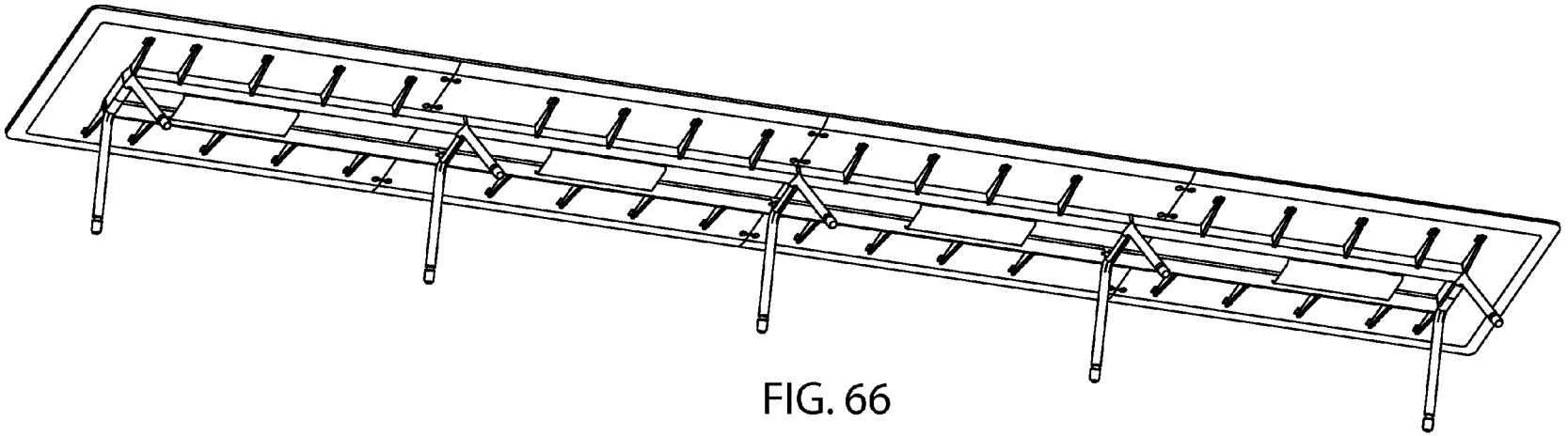
FIG. 66 is a bottom perspective view of the table construction of FIG. 65.
Figure 67:
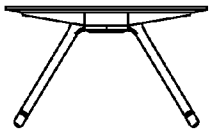
FIG. 67 is an end elevational view of the table construction of FIG. 65.
Figure 68:
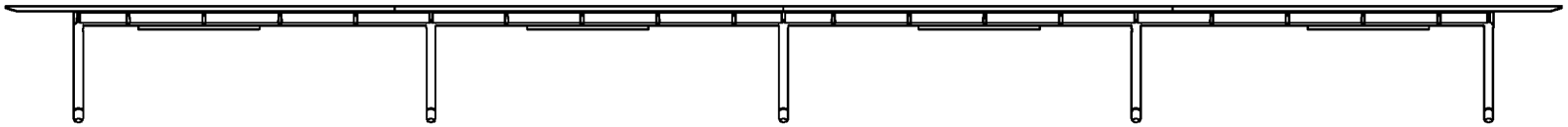
FIG. 68 is a side elevational view of the table construction of FIG. 65.
Figure 69:
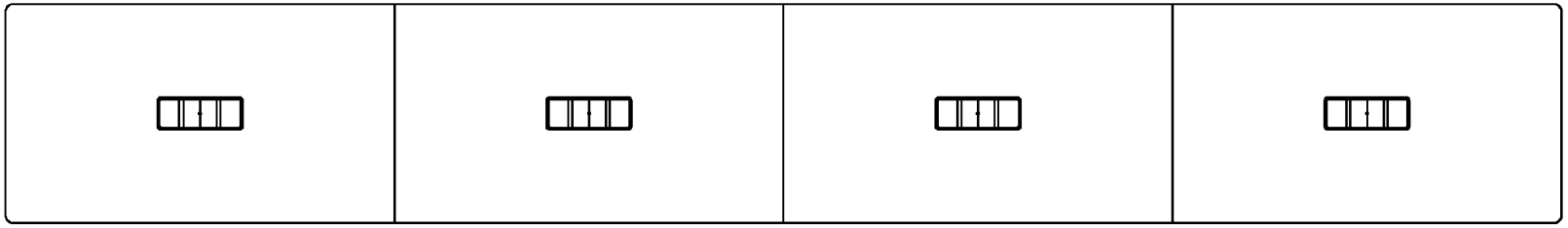
FIG. 69 is a top plan view of the table construction of FIG. 65.
Figure 70:
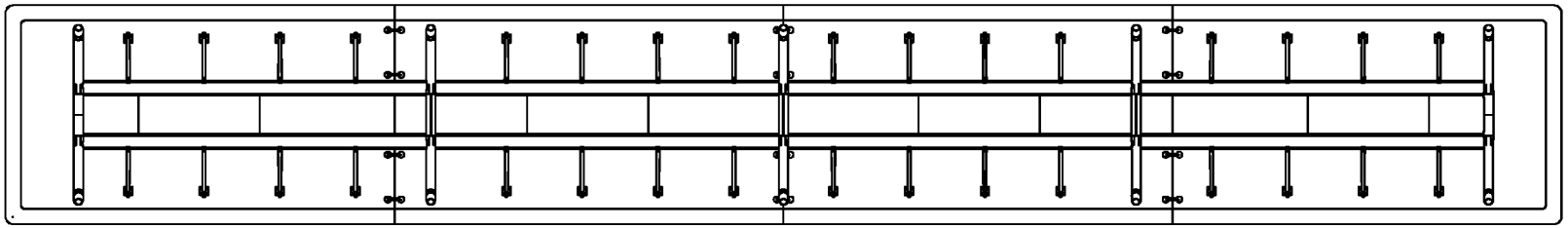
FIG. 70 is a bottom plan view of the table construction of FIG. 65.
Figure 71:
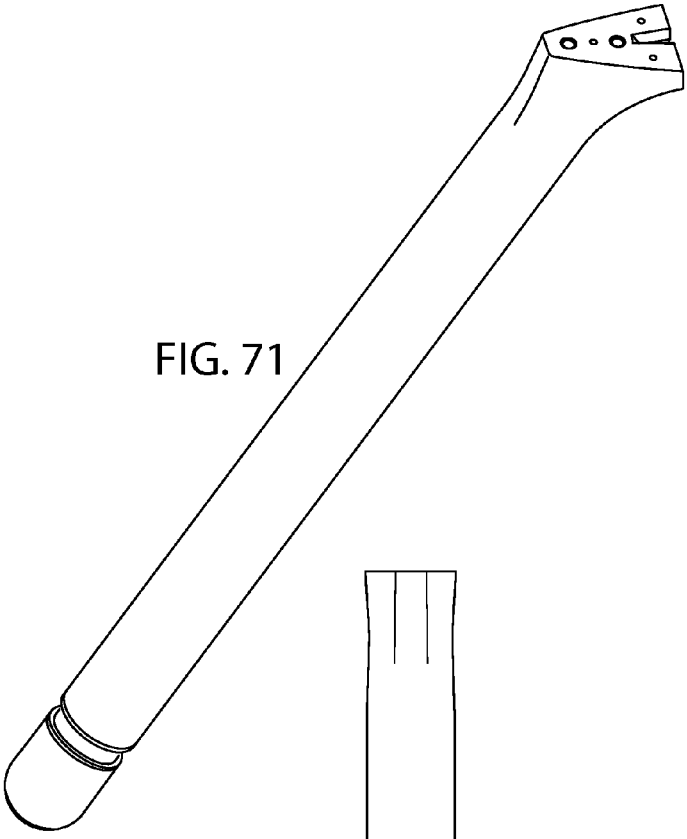
FIG. 71 is a perspective view of a leg assembly.
Figure 72:
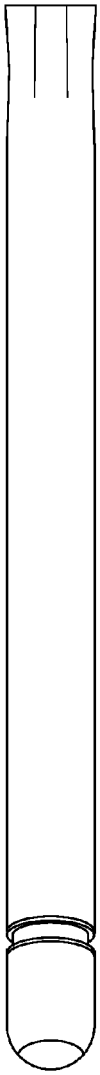
FIG. 72 is a first side elevational view of the leg assembly of FIG. 71.
Figure 73:
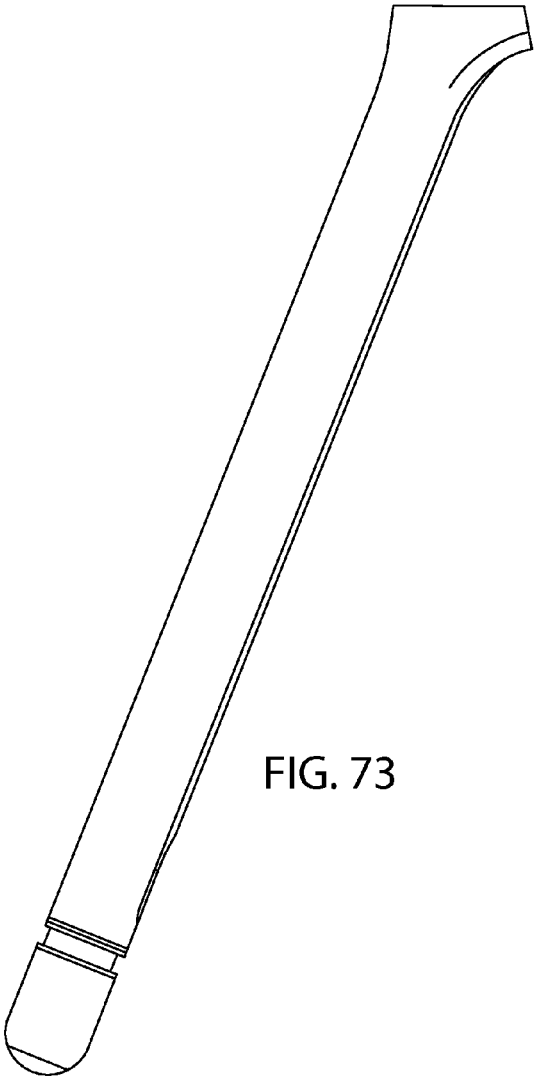
FIG. 73 is a first end elevational view of the leg assembly of FIG. 71.
Figure 74:
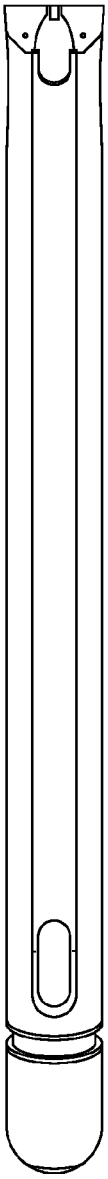
FIG. 74 is a second side elevational view of the leg assembly of FIG. 71.
Figure 75:
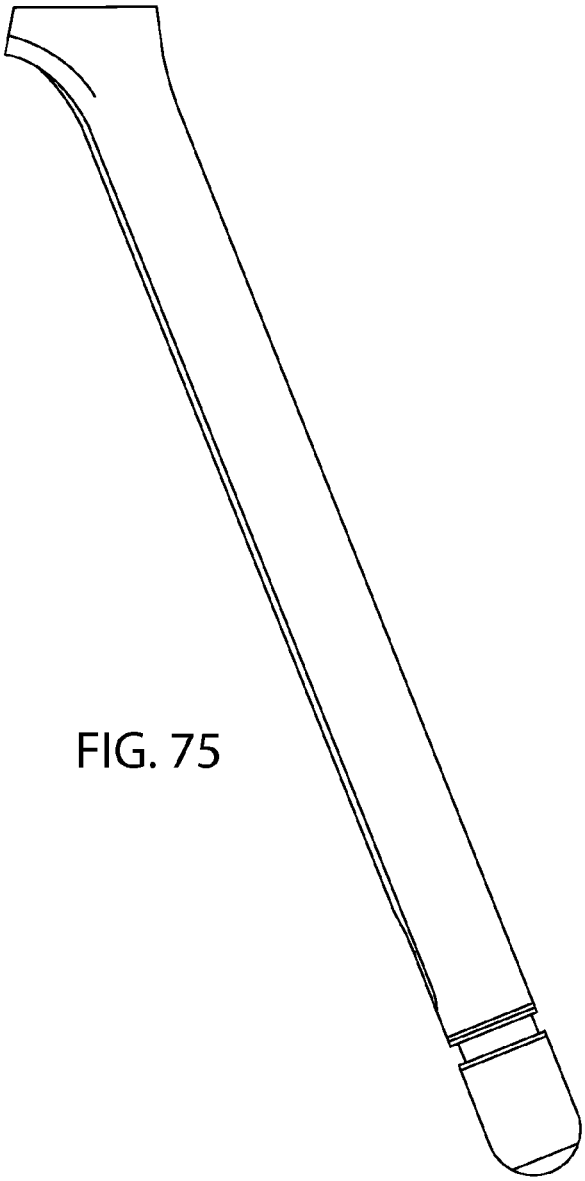
FIG. 75 is a second end elevational view of the leg assembly of FIG. 71.
Figure 76:
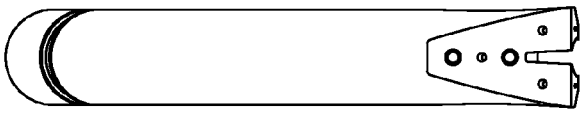
FIG. 76 is a top plan view of the leg assembly of FIG. 71.
Figure 77:
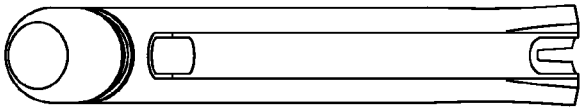
FIG. 77 is a bottom plan view of the leg assembly of FIG. 71.

The connecting plate 62 (FIGS. 4B and 4C) is configured to mount to the trough support bracket 56 at the end plate 60 by the end plate 60 being received in the slot 68 of the connecting plate 62. The connecting plate 62 is then secured thereto by welds at weld location X. The weld locations X are best shown in FIG. 48 with reference to beam connecting bracket assembly 50. With specific reference to FIG. 4C, the trough support bracket 56 is shown coupled to the beam connecting bracket assemblies 50, 52, and a two-part trough support bracket cover 98 is shown exploded away from the trough support bracket 56. The configuration of the connection between the trough support bracket 56 and the beam connecting bracket assemblies 50, 52 is best shown in FIG. 4D with the trough support bracket 56 shown with end plates 58, 60 shown in phantom.

Figure 5:
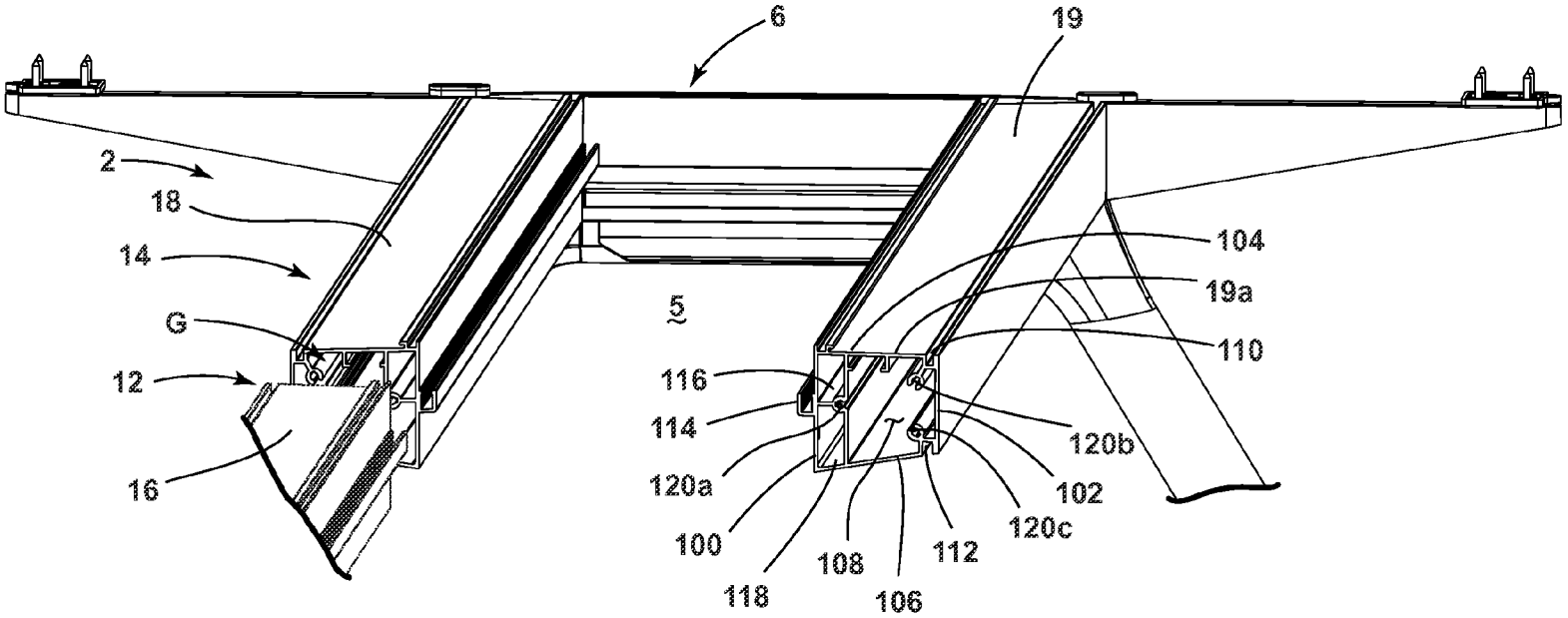
FIG. 5 is a perspective view of the table frame of FIG. 2.

Referring now to FIG. 5, the longitudinally extending beams 16-19 (FIG. 2) have a substantially identical, hollow construction, and are preferably extruded from aluminum or other like material. In FIG. 5, relative to FIG. 2, the beam 17 has been removed, and the center leg assembly 10 has also been removed to reveal a gap G where the center leg assembly 10 is located within the overall assembly (FIG. 2). As shown in FIG. 5, with specific reference to the beam 19, each longitudinal beam 16-19 includes interior and exterior sidewalls 100, 102, an inclined top wall 104, and a bottom wall 106 to define an interior space 108. A pair of elongate grooves 110, 112 are formed along the intersections of the top wall 104 and the bottom wall 106 with the exterior sidewall 102, and serve to detachably support the plurality of cantilevered top support brackets 15 (FIG. 2) along the outer edges of the beams 16-19. An interior groove 114 is provided along each of the interior faces of the beams 16-19 extending inwardly from the interior sidewall 100 and serves to detachably support wire management troughs 7 in the elongate window 5. Further, a channel 115 and an adjacent connecting flange 115*a* are formed on the inclined top wall 104 near the interior sidewall 100 for connecting to work-surface connecting brackets and the like.

The interior space 108 (FIG. 5) of the beam 19 includes upper and lower compartments 116, 118 located adjacent to the interior sidewall 100 and an open slot 119 disposed on an underside of the inclined top wall 104. The upper and lower compartments 116, 118 are configured to receive the upper and lower connecting flanges 70, 72 or the upper and lower connecting flanges 76, 78 of the connecting plate 62 of a corresponding linear beam interconnecting bracket assembly 50, 52, depending on the orientation of the table 1 (FIG. 1). The interior 108 of the beam 19 further includes mounting bosses 120*a*, 120*b*, 120*c* which are accessible from the innermost end 19*a* of the beam 19. As noted above, the beam 17 has been removed from FIG. 5, however, it is to be understood that the beam 17 also includes interior compartments similar to the upper and lower compartments 116, 118 and the mounting bosses 120*a*-120*c* shown with reference to the beam 19. The mounting bosses 120*a*-120*c* are configured to align with the fasteners 82*a*-82*c* (FIG. 4B) for mounting a beam to an associated beam connecting bracket assembly, such as the beam connecting assemblies 50, 52. The mounting bosses 120*a*-120*c* are shown accessible at the innermost end 19*a* of the beam 19, but are also contemplated to be accessible at the outermost end 19*b* of the beam 19. In this way, the mounting bosses 120*a*-120*c* can be used to mount an end leg assembly, such as the end leg assembly 6 shown in FIG. 5, to the beams 18, 19. Thus, the center leg assembly 10 provides a connecting support member to connect the first and second sets of parallel beams 12, 14 in a linearly aligned manner by connecting the beam 16 to the beam 18, and further connecting the beam 17 to the beam 19 at the innermost faces (16*a*-19*a*) thereof, as shown in FIG. 2.

Figure 6A:
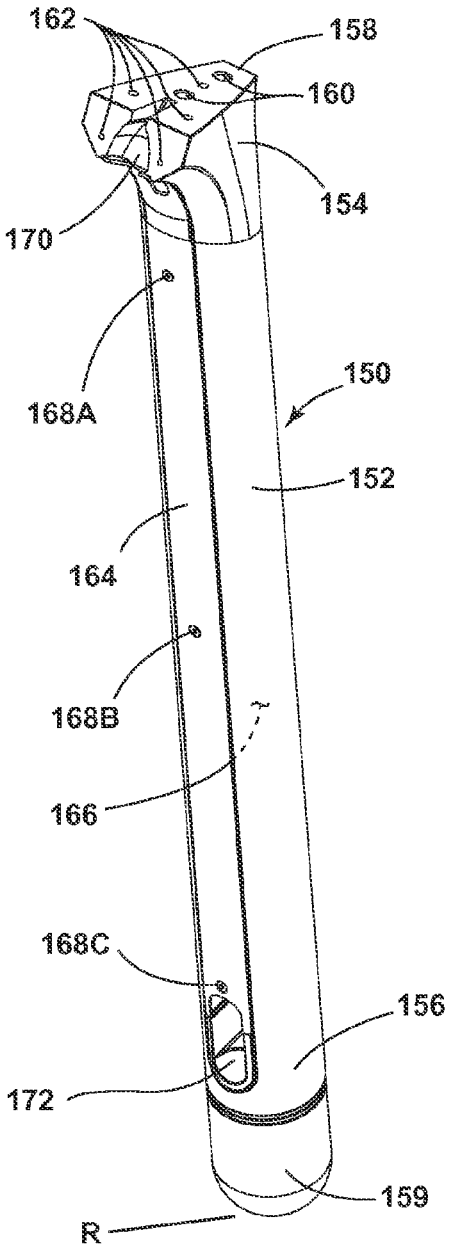
FIG. 6A is a perspective view of a leg assembly according to another embodiment of the present invention.
Figure 6B:
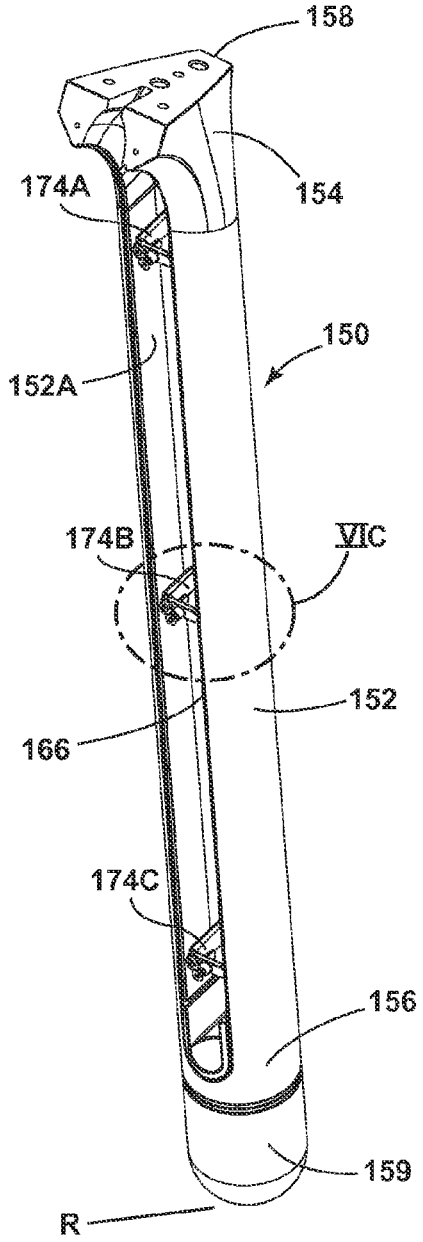
FIG. 6B is a perspective view of the leg assembly of FIG. 6A having a cover member removed therefrom.
Figure 6C:
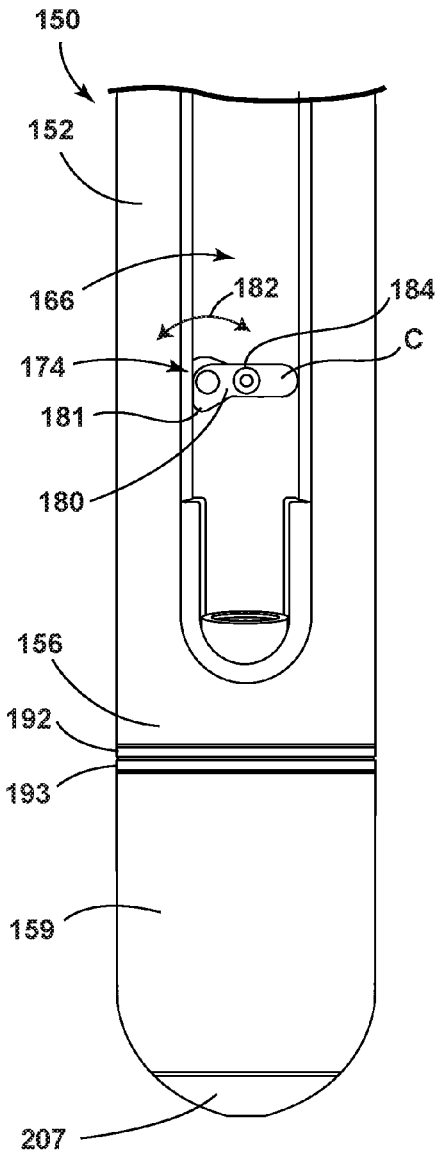
FIG. 6C is an enlarged perspective view of an end of the leg assembly of FIG. 6A with a retainer in a closed position.

As noted above, the legs 20, 22 and 42, 44 are similar in construction and the specific configuration of the legs will now be described with reference to FIGS. 6A-6C. Referring now to FIG. 6A, a leg assembly 150 is shown having a main body portion 152 with upper and lower ends 154, 156. The upper end 154 includes a connecting surface 158 having a plurality of mounting apertures 160, 162 disposed thereon. The connecting surface 158 and mounting apertures 160, 162 are used to couple the leg assembly 150 to an associated mounting bracket of the table frame 2 (FIG. 2). A base member 159 is coupled to the lower end 156 and is adjustable with respect to the body portion 152, as further described below. A cover member 164 is shown coupled to the body portion 152 of the leg assembly 150, wherein the cover member 164 is a removable cover member configured to close off a wireway or raceway 166 disposed centrally and extending longitudinally along the body portion 152 of the leg assembly 150. The raceway 166, best shown in FIG. 6B, is essentially defined by a hollow interior of the body portion 152 and is used to route wires, cables, data and power connections through the leg assembly 150. Upper and lower access apertures 170, 172 are defined between the end of the cover member 164 and the edges of the raceway 166. The upper and lower access apertures 170, 172 provide near tabletop access and near floor level access to the raceway 166, respectively, for wires and cables routed through the raceway 166. As shown in FIG. 6A, the lower access aperture 172 is generally defined by a relief portion disposed in the cover member 164 and a relief portion disposed on the body portion 152 of the leg assembly 150.

Figure 6D:
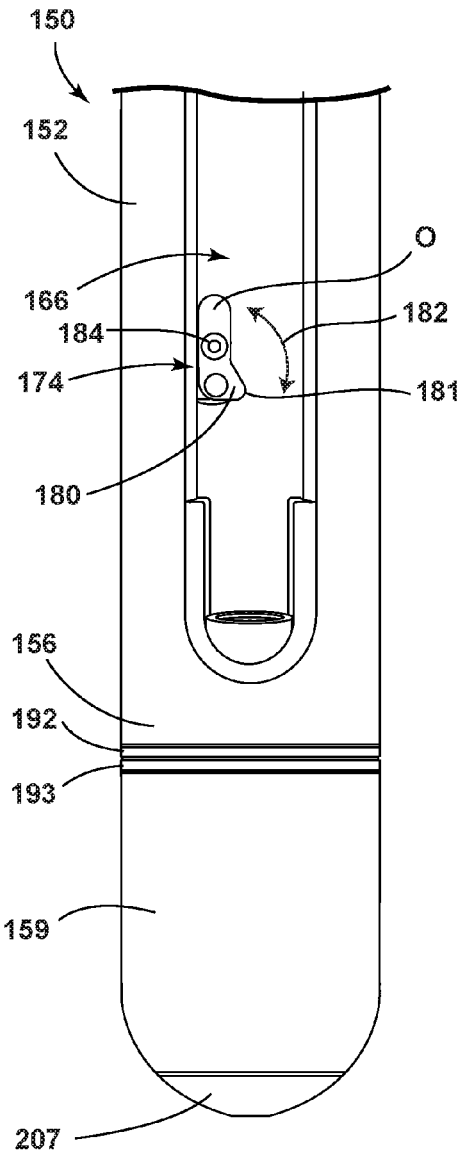
FIG. 6D is an enlarged perspective view of an end of the leg assembly of FIG. 6A with a retainer in an open position.

Referring now to FIG. 6B, the cover member 164 has been removed to fully reveal the raceway 166 which is generally defined by an inner surface 152A of the body portion 152. Disposed within the raceway 166, a number of spaced-apart wire retainer assemblies 174A-174C are mounted to the inner surface 152A of the body portion 152 of the leg assembly 150. In use, the wire retainer assemblies 174A-174C are configured to retain wires and cables routed through the raceway 166. With specific reference to FIG. 6C, the wire retainer assembly 174B is shown as a representative image of the wire retainer assemblies 174A-174C shown in FIG. 6B. The wire retainer assembly 174B is mounted via a fastener, such as a screw 176, to a mounting location or boss 178B disposed on the inner surface 152A of the body portion 152 of the leg assembly 150. Each wire retainer assembly 174A-174C includes a retainer bracket 180 pivotably coupled to an end of the boss 178B by the screw 176, such that the retainer bracket 180 is pivotable in direction 182 between an open position O (FIG. 6C) and a closed position C (FIG. 6D). A stop tab 181 is configured to abut an inner wall of the raceway 166 to prevent over-rotation of the retainer bracket 180 from the open position O to the closed position C. In the illustrated example, the retainer bracket 180 includes a mounting boss 184 disposed on a central portion thereof. In assembly, the mounting bosses 184 of the retainer brackets 180 align with mounting apertures 168A-168C disposed on the cover member 164 for coupling the cover member 164 to the leg assembly 150 at the locations of the wire retainer assemblies 174A-174C via fasteners 186. Preferably, the wire retainer assemblies comprise a molded plastic, however, other suitable materials including wood may also be utilized. The configuration of the wire retainer assemblies allows an installer or user to secure wires within the raceway before installing the cover member and similarly to keep wires secured within the raceway after removing the cover members, improving the efficiency of installation and ease of wire management during use. The number of wire retainer assemblies may vary in some embodiments depending on the length of the leg, the types of wires likely to be secured within the raceway, and/or other constraints.

Figure 6E:
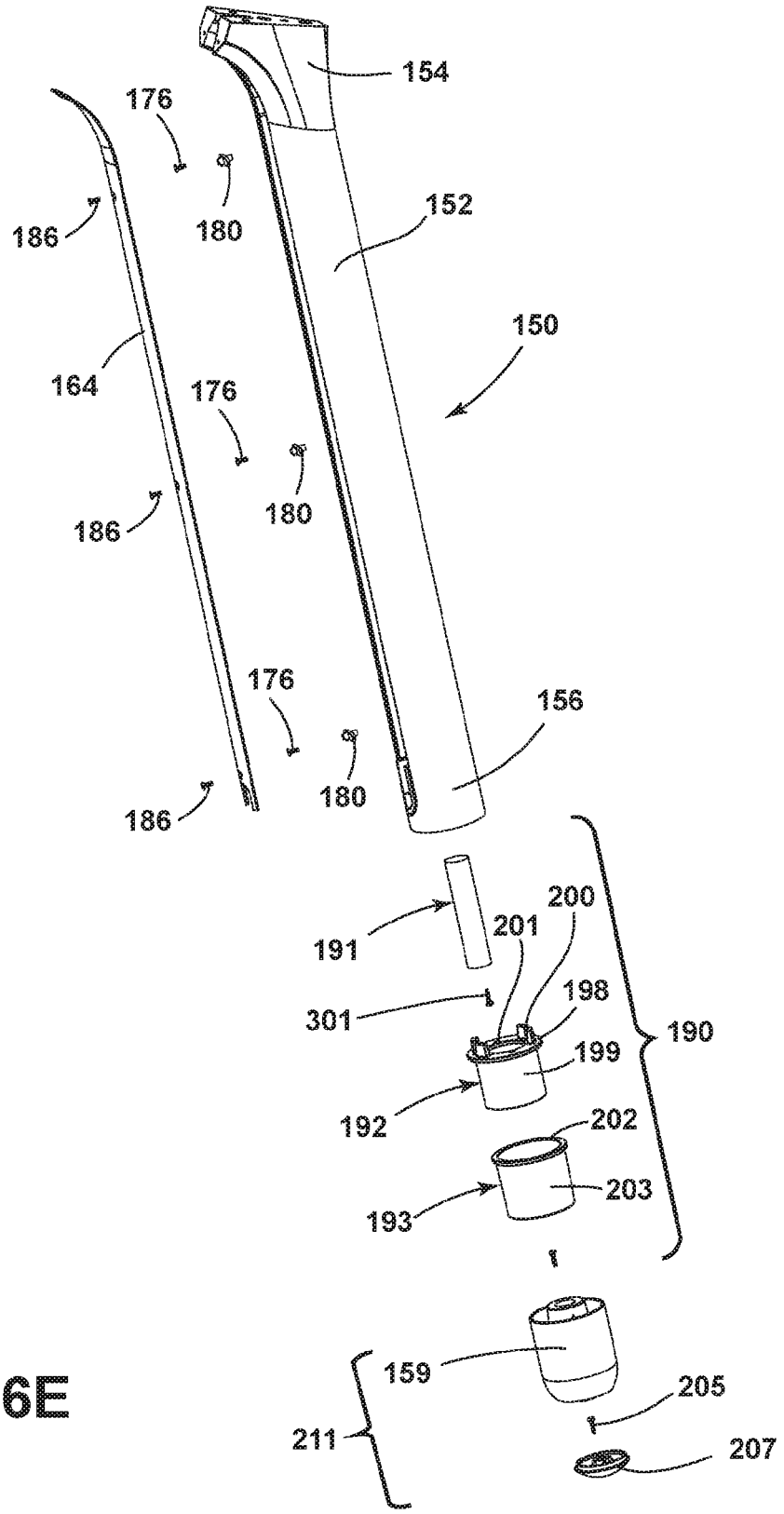
FIG. 6E is an exploded side elevational view of the leg assembly of FIG. 6A.
Figure 7A:
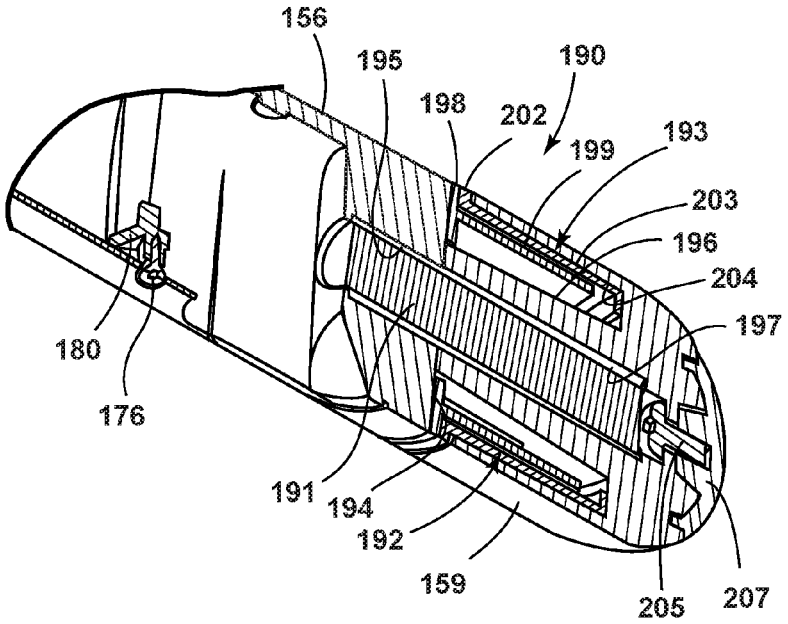
FIG. 7A is a cross-sectional view of the leg assembly of FIG. 6A, with a base member in a lowered position.

Referring to FIG. 6E, the base member 159 of the leg assembly 150 is shown exploded away from the body portion 152. An exploded adjustment mechanism 190 (FIG. 7A) is shown near the lower end 156 of the leg assembly 150. In assembly, the adjustment mechanism 190 is positioned between and couples the base member 159 to the body portion 152 of the leg assembly 150. In use, the adjustment mechanism 190 adjusts the base member 159 of the leg assembly 150 relative to the body portion 152 of the leg assembly 150. The adjustment mechanism 190 allows for the overall leg assembly 150 to be adjusted for uneven surfaces, or other like conditions which may prevent a table frame from providing a level worksurface. In the illustrated example, the adjustment mechanism 190 includes a threaded shaft 191 and a pair of collar members, including a first collar member 192 and a second collar member 193. Specifically, the lower end 156 of the body portion 152 (a portion of which is shown in FIGS. 6E and 7A) includes an end wall 194 having a centrally located threaded aperture 195 that threadably receives the threaded shaft 191 therein. Alternatively, the threaded shaft 191 may be fixedly received within the aperture 197 such that the shaft 191 does not rotate with respect to the body portion 152. The base member 159 includes a centrally located boss 196 that includes the threaded aperture 197 that receives an opposite end of the threaded shaft 191 therein, such that rotating the base member 159 with respect to the body portion 150 either moves the base member 159 closer to or away from the body portion 150, thereby shortening or extending an overall length of the leg assembly 150 as described below.

Figure 7B:
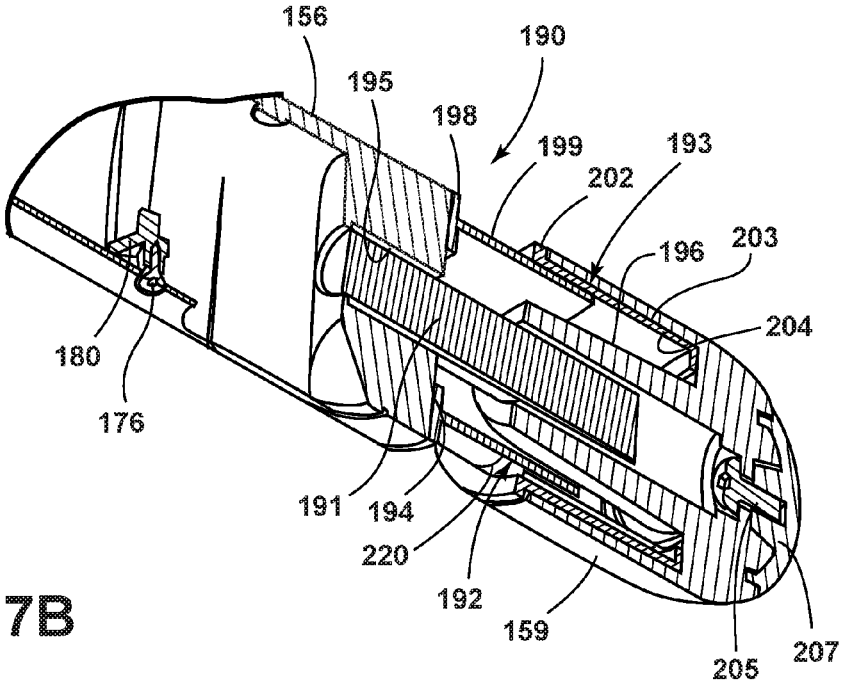
FIG. 7B is a cross-sectional view of the leg assembly of FIG. 6A, with the base member in a raised position.

The first collar member 192 includes a circumferentially-extending lip 198 extending about a cylindrical wall 199 and a pair of mounting legs 200 extending from the lip 198. The lip 198 includes mounting apertures 201 that receive a mounting screw 301 therein, which is ultimately threadably received into one of a pair of corresponding mounting apertures (not shown) located within the end wall 194 of the lower end 156 of the body portion 152, thereby securing the first collar member 192 to the lower end 156. As best illustrated in FIGS. 7A and 7B, the second collar member 193 includes a circumferentially-extending lip 202 extending about an end of a cylindrical wall 203 that is received into an interior 204 of the base member 159 and which telescopingly receives the cylindrical wall 199 of the first collar member 192 therein.

Further, either of the collar members 192, 193 may include a position indication line 220 positioned along the length thereof so as to provide a visual indication of the overall travel and position of the adjustment mechanism 190, thereby preventing an operator from accidentally completely removing the base member 159 from threaded engagement with the shaft 191. Similarly, the distal ends of either one or both of the collar members 192, 193 may be utilized in a similar manner by indicating to the operator that an extreme range of adjustment or travel of the adjustment mechanism 193 has been reached. It is also noted that the collar members 192, 193 can be provided in a variety of colors to either match or compliment colors selected for the remaining parts of the leg assembly 150 and/or worksurfaces 3, 4. As further shown in FIGS. 6E, 7A, 7B a fastener 205 is received through an aperture 206 of the base member 159 and couples a foot member or plug 207 to the lower end of the base member 159, such that the base member 159 and the foot member 207 cooperate to form a base member assembly 211. The foot member 207 may be provided in a variety of configurations and in a variety of materials so as to provide a gripping support with an associated floor surface, a sliding support with the floor surface, a wear resistant surface, and the like. It is noted that the configuration of the foot member 207 and the base member 159 allow for easy replacement of the foot member 207 should the foot member 207 become worn, damaged or discolored.

Figure 8:
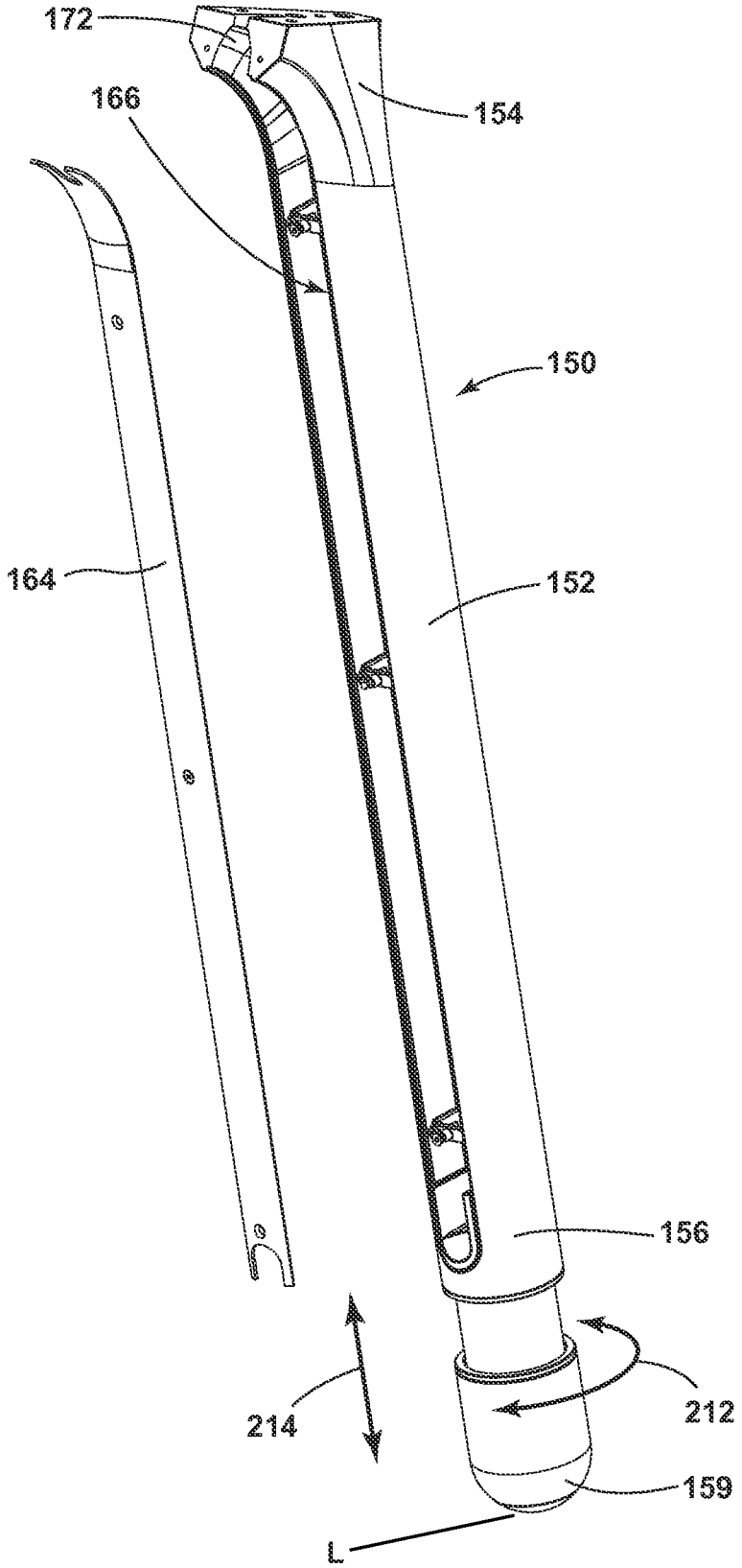
FIG. 8 is a perspective view of the leg assembly of FIG. 6A showing the base member in a raised position and a cover exploded from the remainder of the leg assembly.
Figure 9:
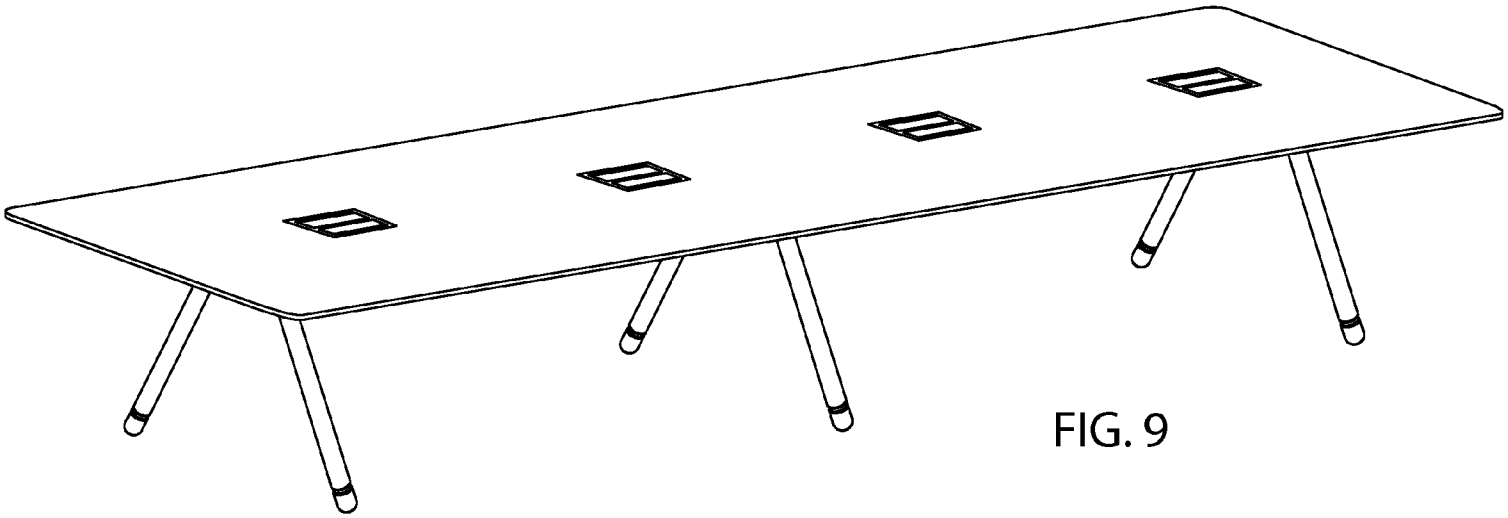
FIG. 9 is a top perspective view of a table construction.
Figure 10:
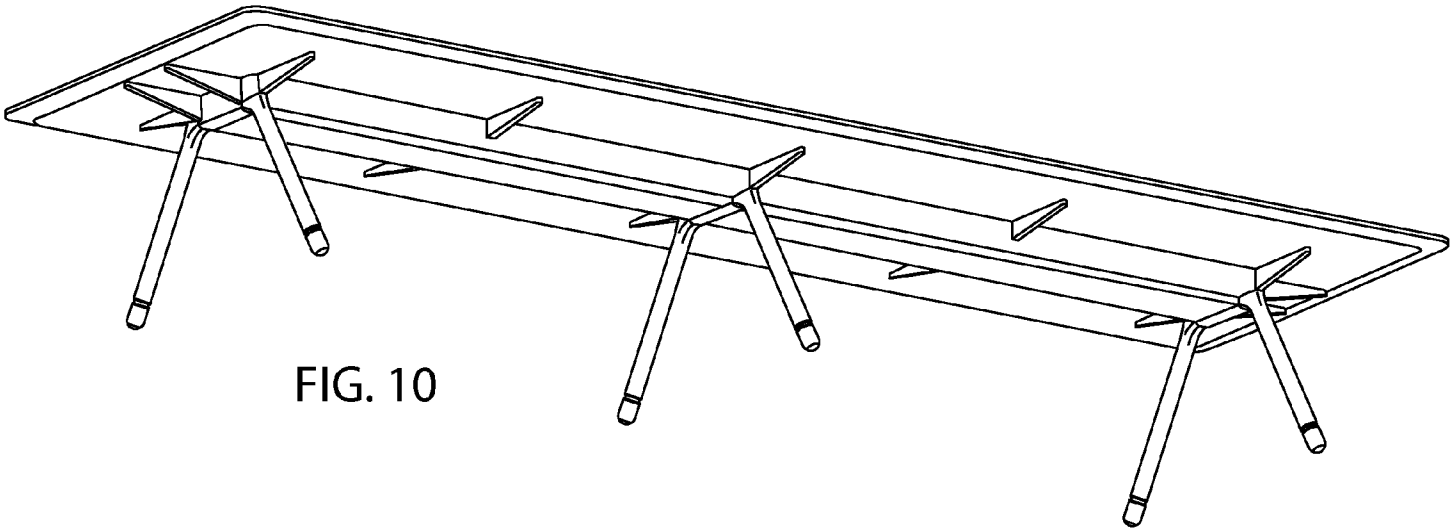
FIG. 10 is a bottom perspective view of the table construction of FIG. 9.
Figure 11:
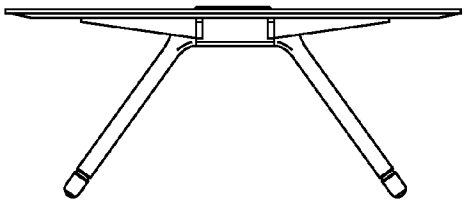
FIG. 11 is an end elevational view of the table construction of FIG. 9.
Figure 12:
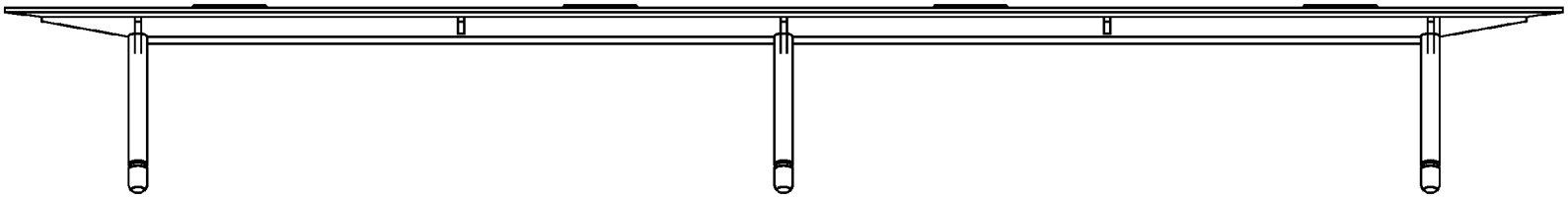
FIG. 12 is a side elevational view of the table construction of FIG. 9.
Figure 13:
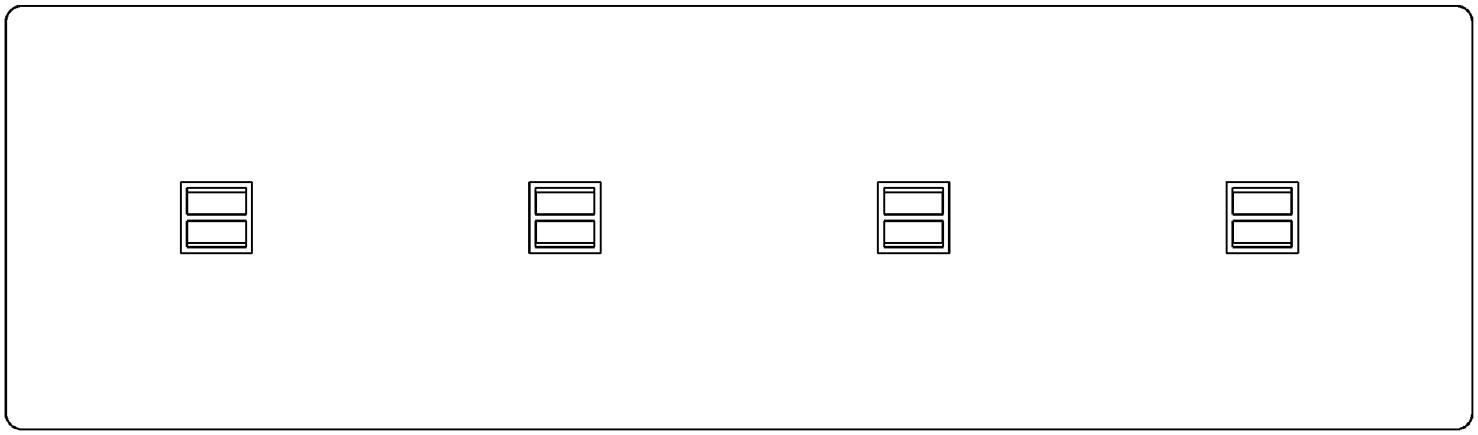
FIG. 13 is a top plan view of the table construction of FIG. 9.
Figure 14:
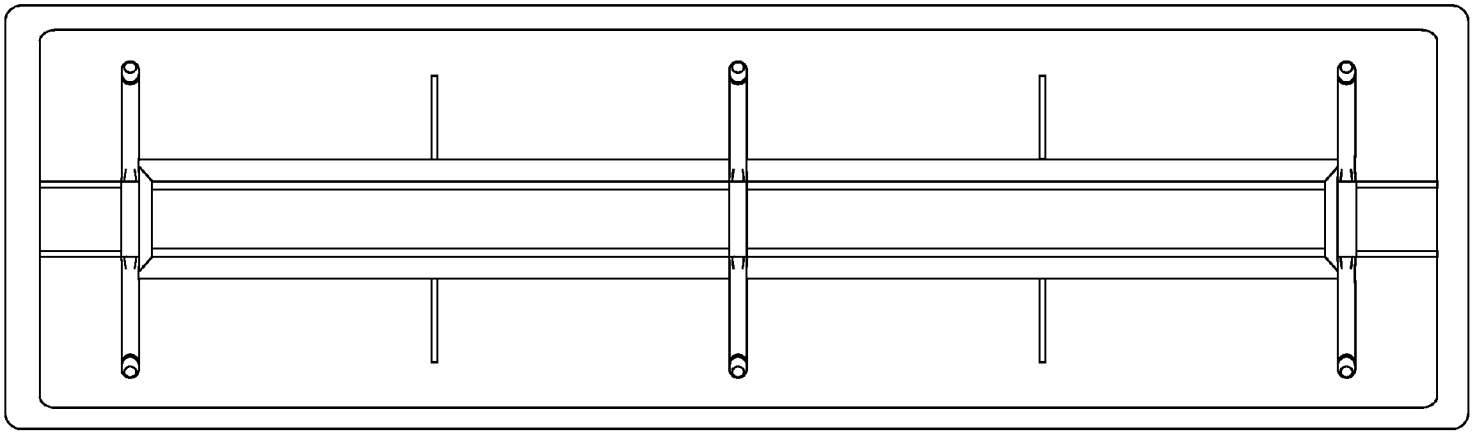
FIG. 14 is a bottom plan view of the table construction of FIG. 9.
Figure 15:
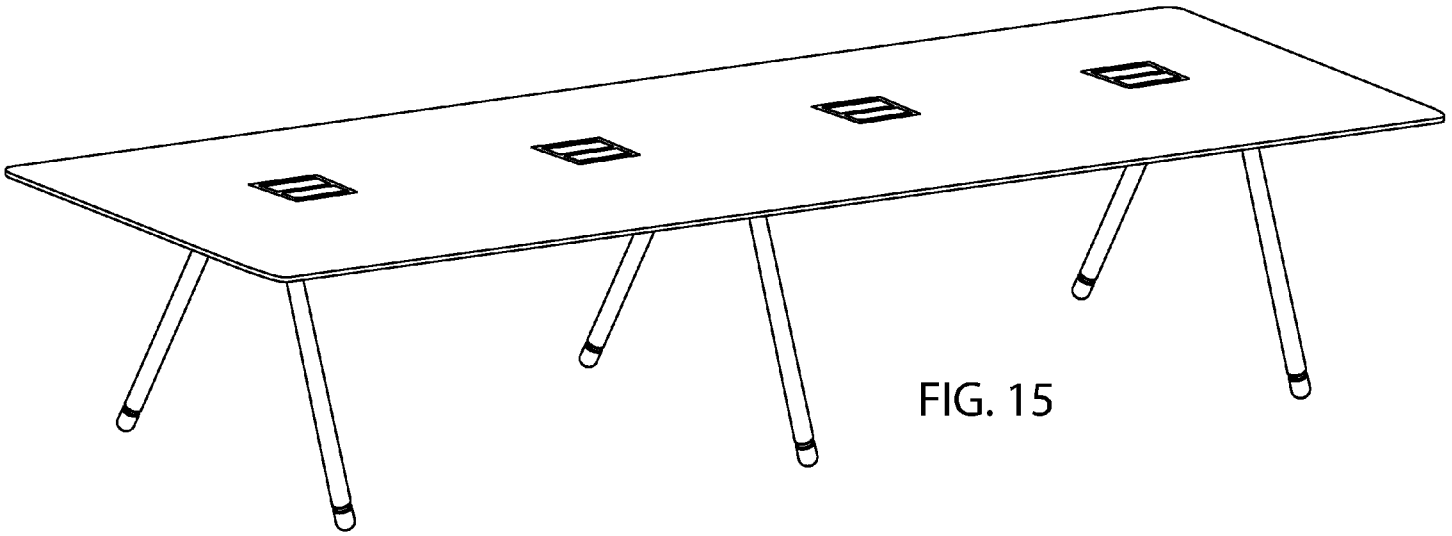
FIG. 15 is a top perspective view of a table construction.
Figure 16:
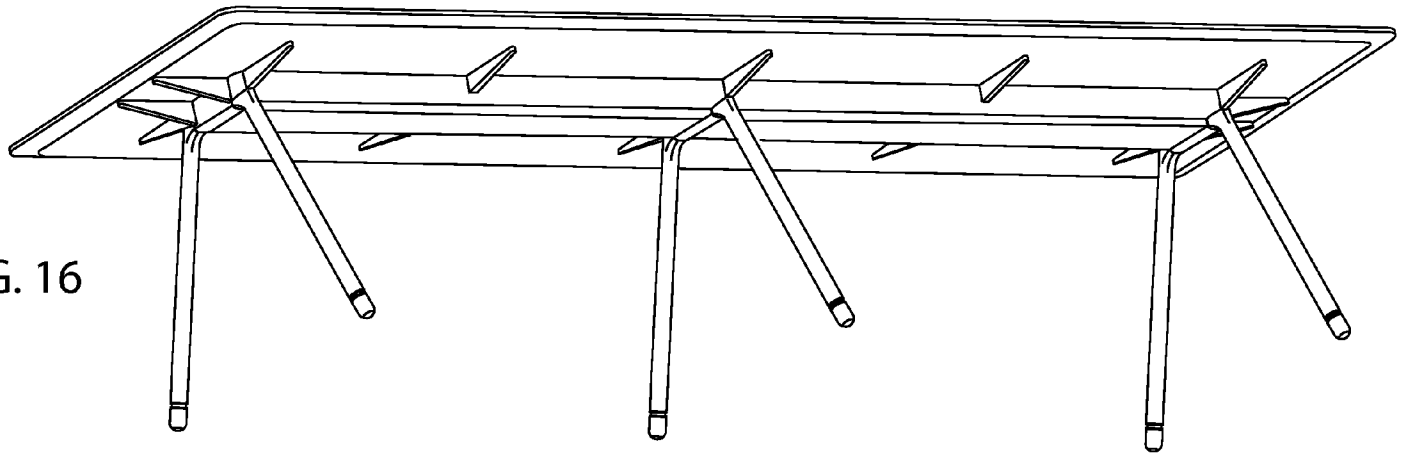
FIG. 16 is a bottom perspective view of the table construction of FIG. 15.
Figure 17:
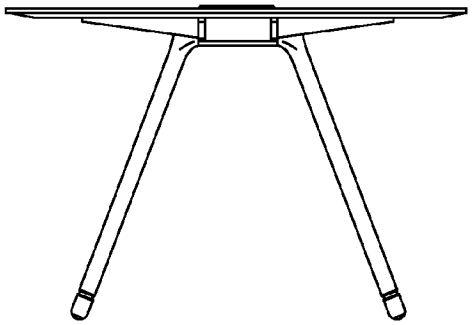
FIG. 17 is an end elevational view of the table construction of FIG. 15.
Figure 18:
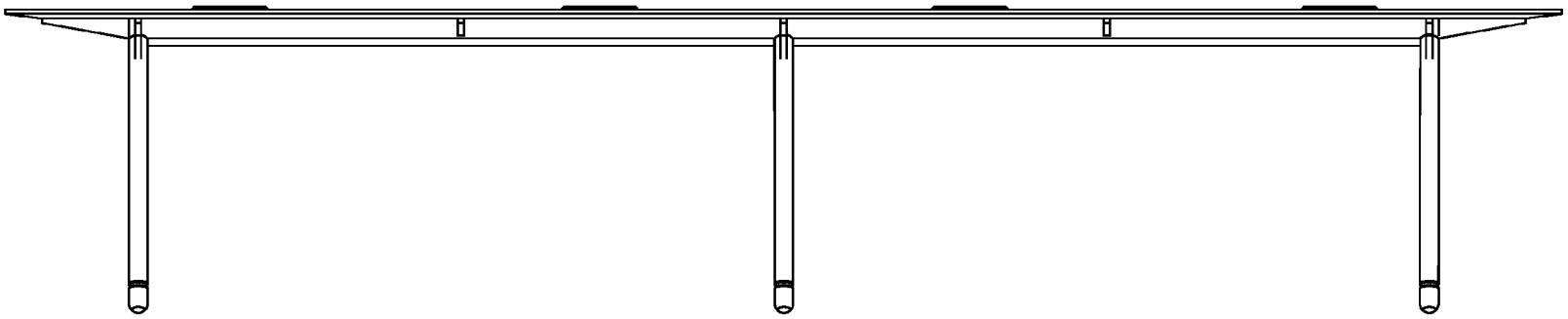
FIG. 18 is a side elevational view of the table construction of FIG. 15.
Figure 19:
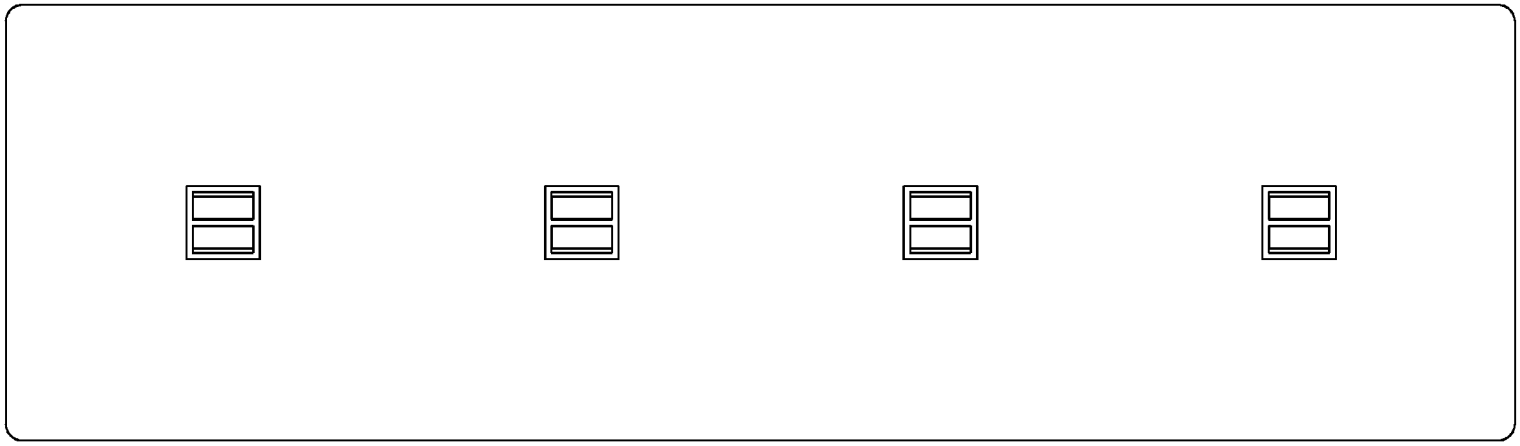
FIG. 19 is a top plan view of the table construction of FIG. 15.
Figure 20:
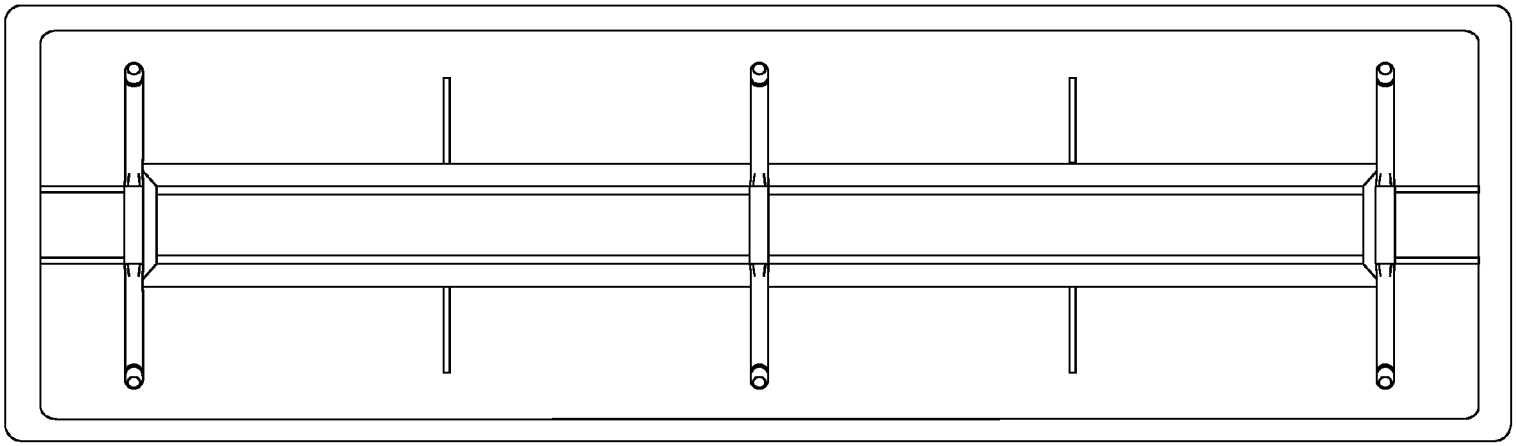
FIG. 20 is a bottom plan view of the table construction of FIG. 15.
Figure 21:
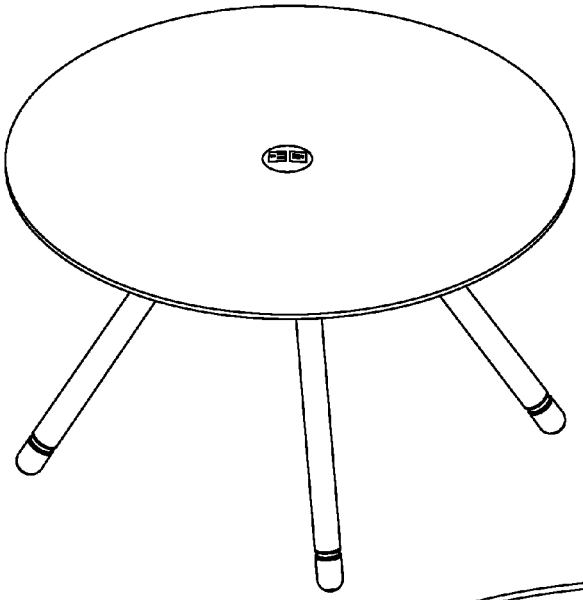
FIG. 21 is a top perspective view of a table construction.
Figure 22:
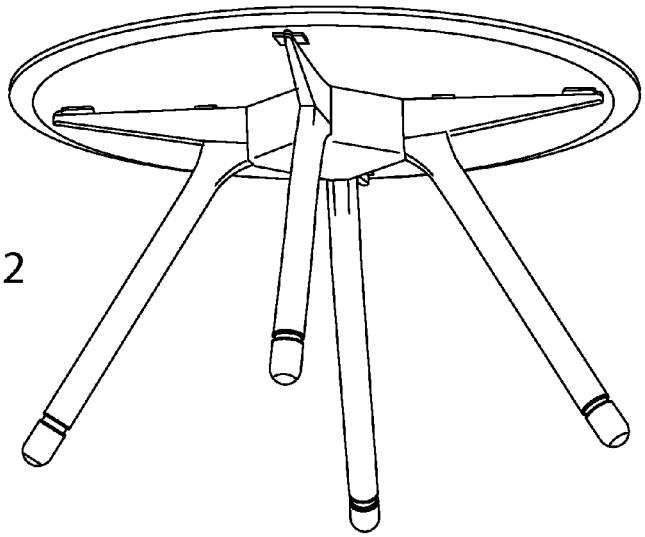
FIG. 22 is a bottom perspective view of the table construction of FIG. 21.
Figure 23:
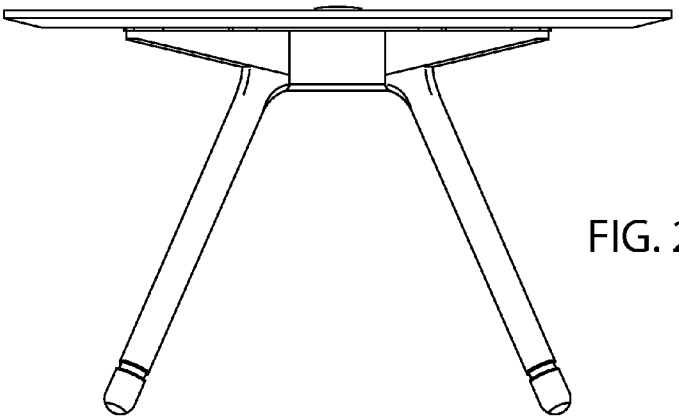
FIG. 23 is a side elevational view of the table construction of FIG. 21.
Figure 24:
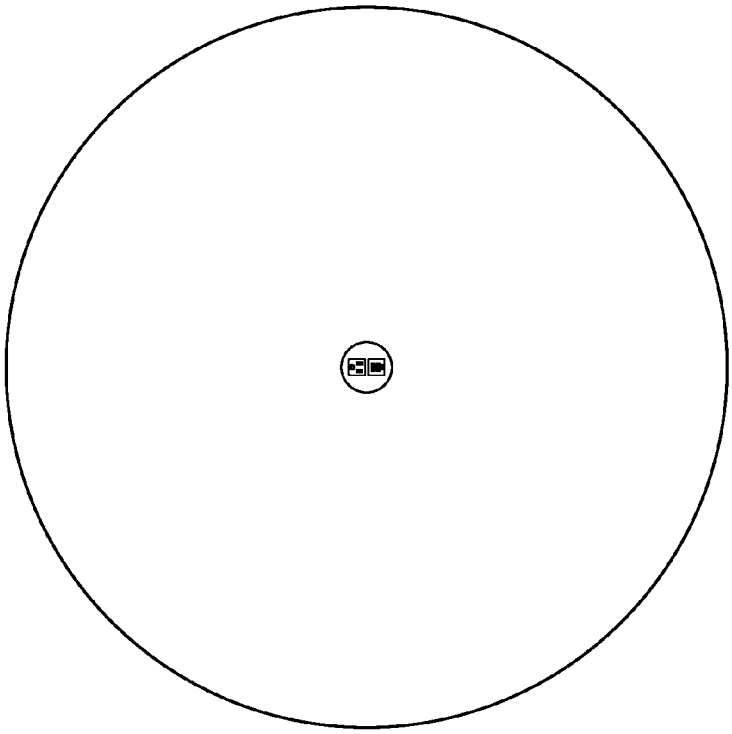
FIG. 24 is a top plan view of the table construction of FIG. 21.
Figure 25:
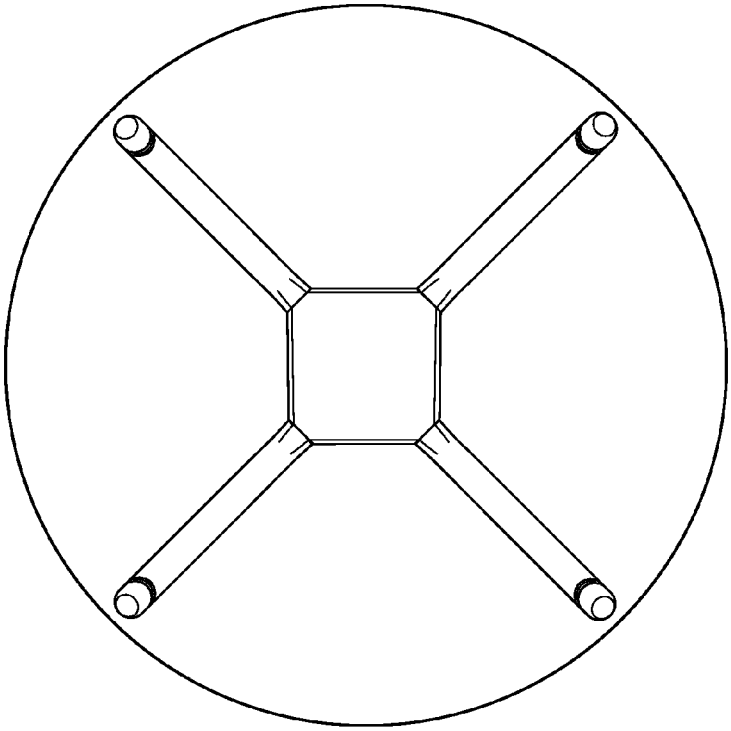
FIG. 25 is a bottom plan view of the table construction of FIG. 21.
Figure 26:
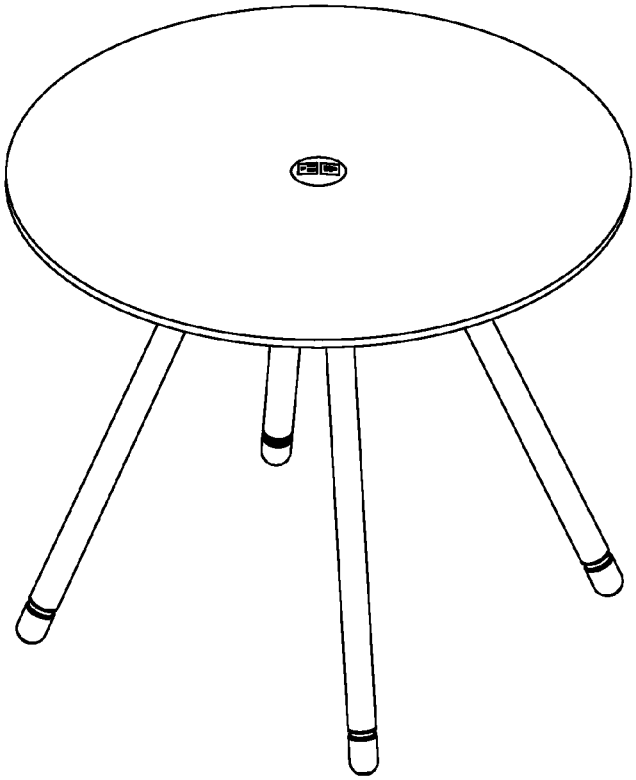
FIG. 26 is a top perspective view of a table construction.
Figure 27:
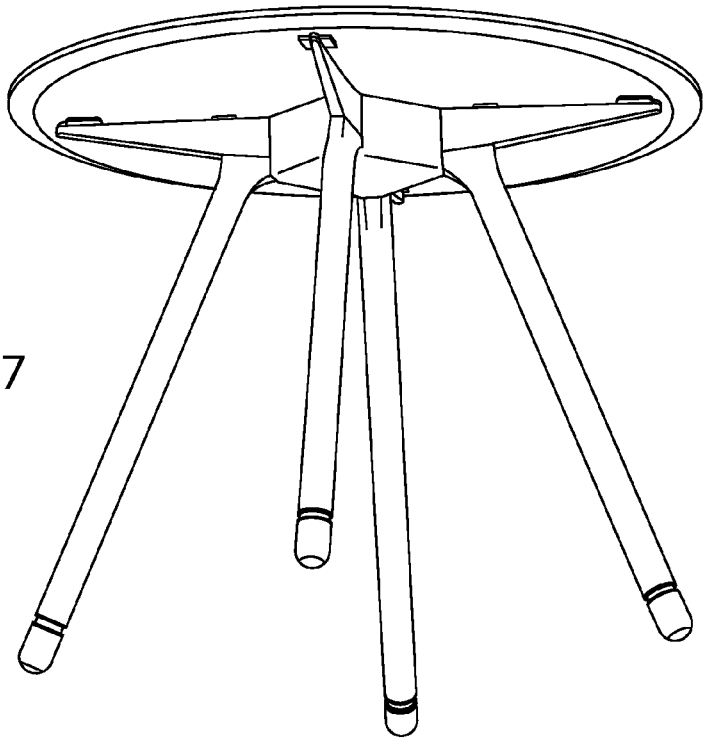
FIG. 27 is a bottom perspective view of the table construction of FIG. 26.
Figure 28:
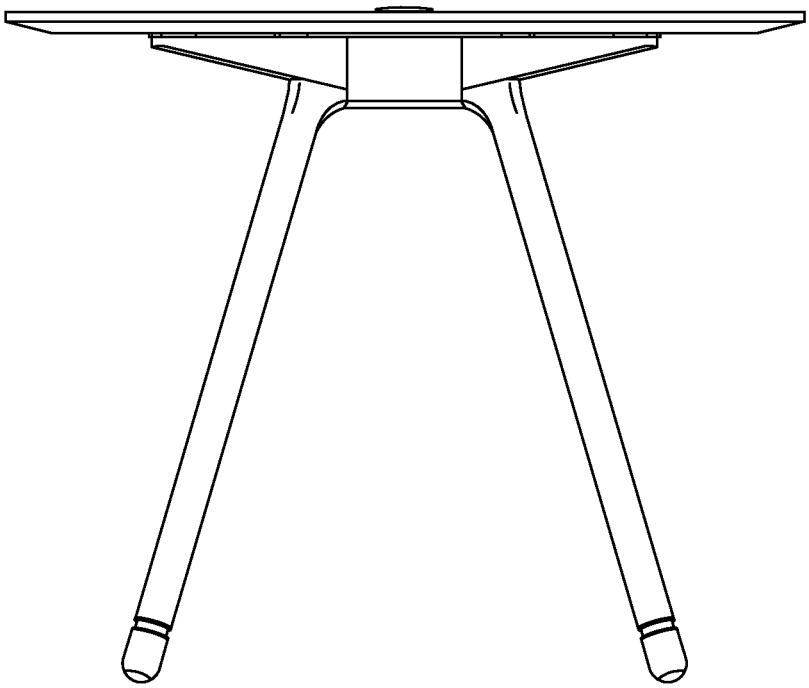
FIG. 28 is a side elevational view of the table construction of FIG. 26.
Figure 29:
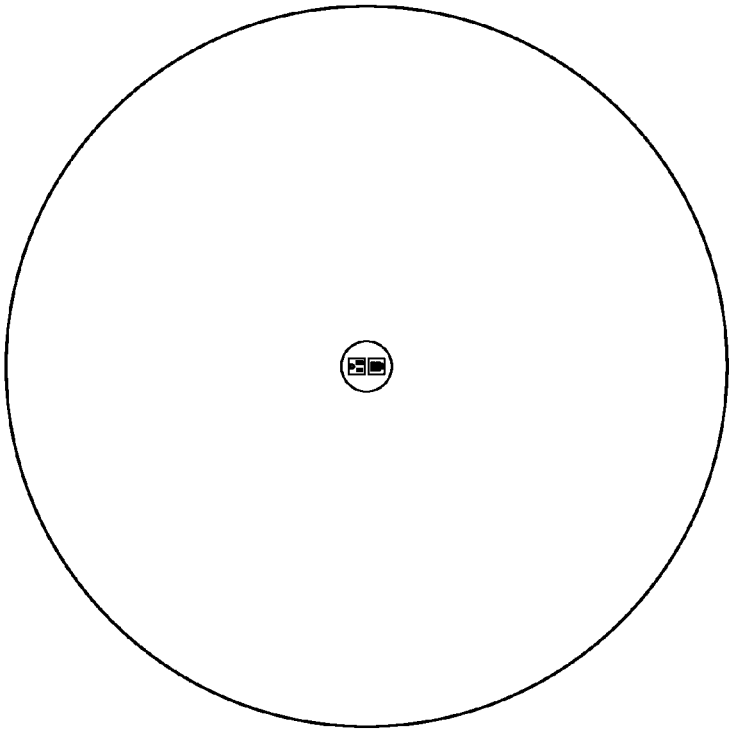
FIG. 29 is a top plan view of the table construction of FIG. 26.
Figure 30:
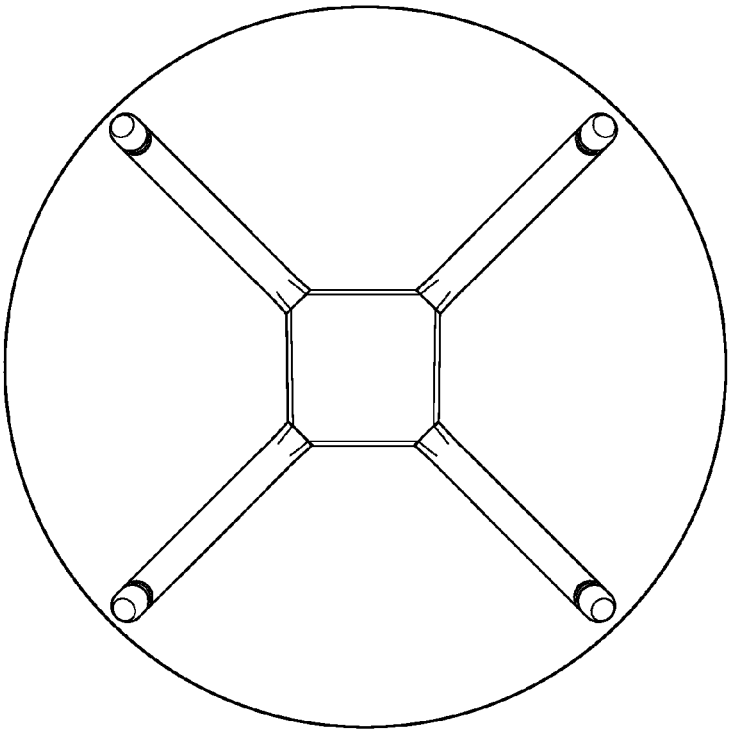
FIG. 30 is a bottom plan view of the table construction of FIG. 26.
Figure 31:
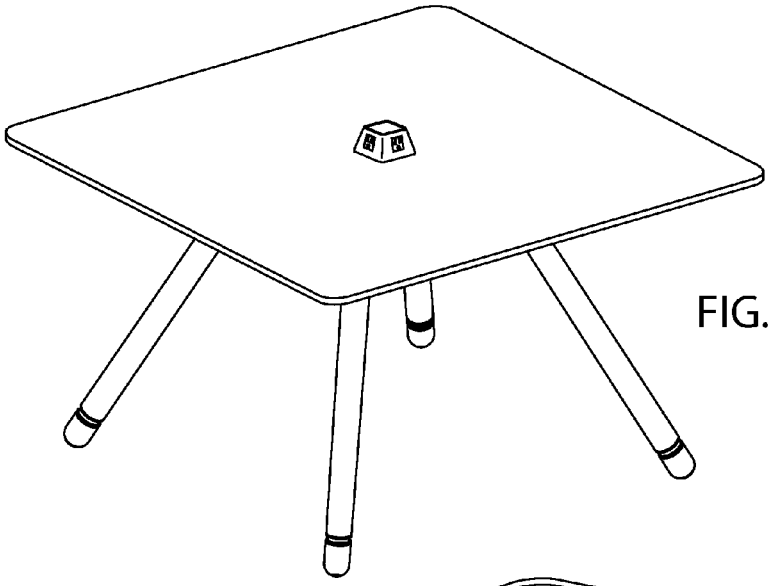
FIG. 31 is a top perspective view of a table construction.
Figure 32:
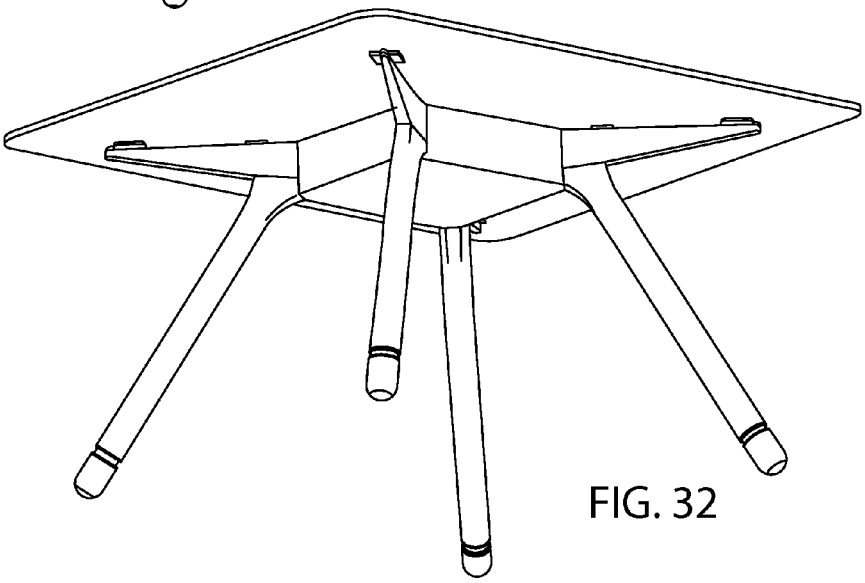
FIG. 32 is a bottom perspective view of the table construction of FIG. 31.
Figure 33:
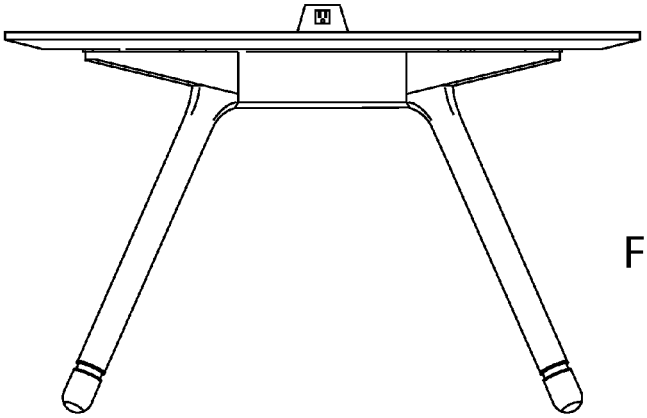
FIG. 33 is a side elevational view of the table construction of FIG. 31.
Figure 34:
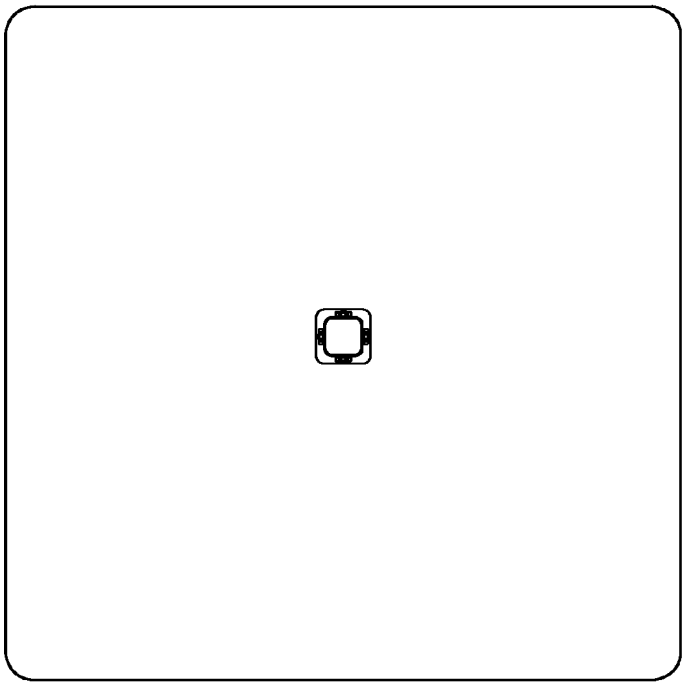
FIG. 34 is a top plan view of the table construction of FIG. 31.
Figure 35:
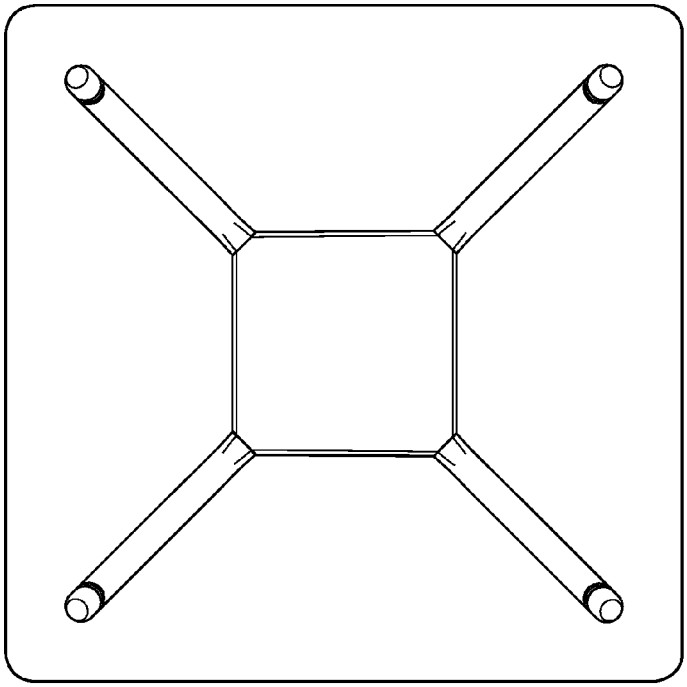
FIG. 35 is a bottom plan view of the table construction of FIG. 31.
Figure 36:
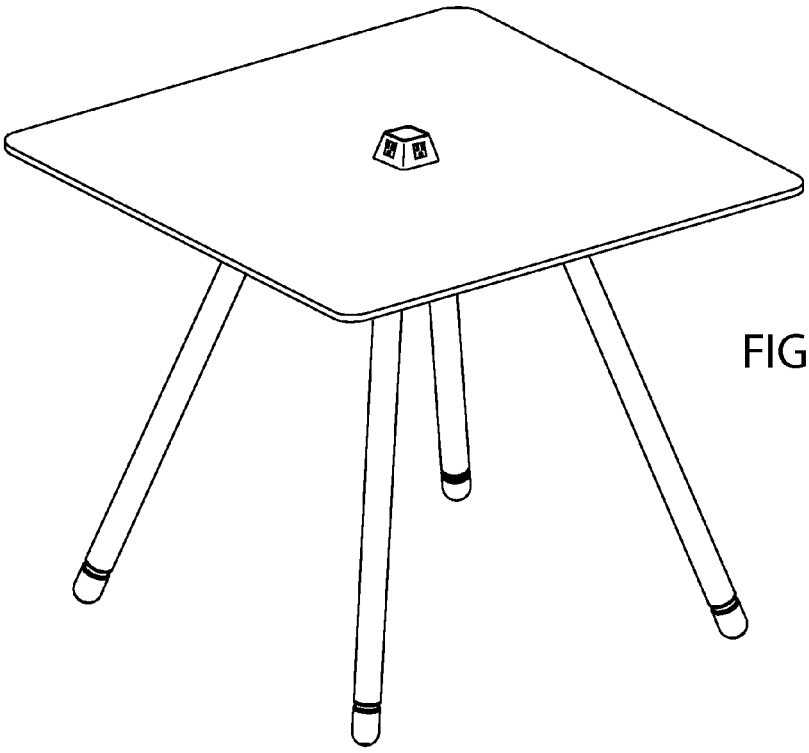
FIG. 36 is a top perspective view of a table construction.
Figure 37:
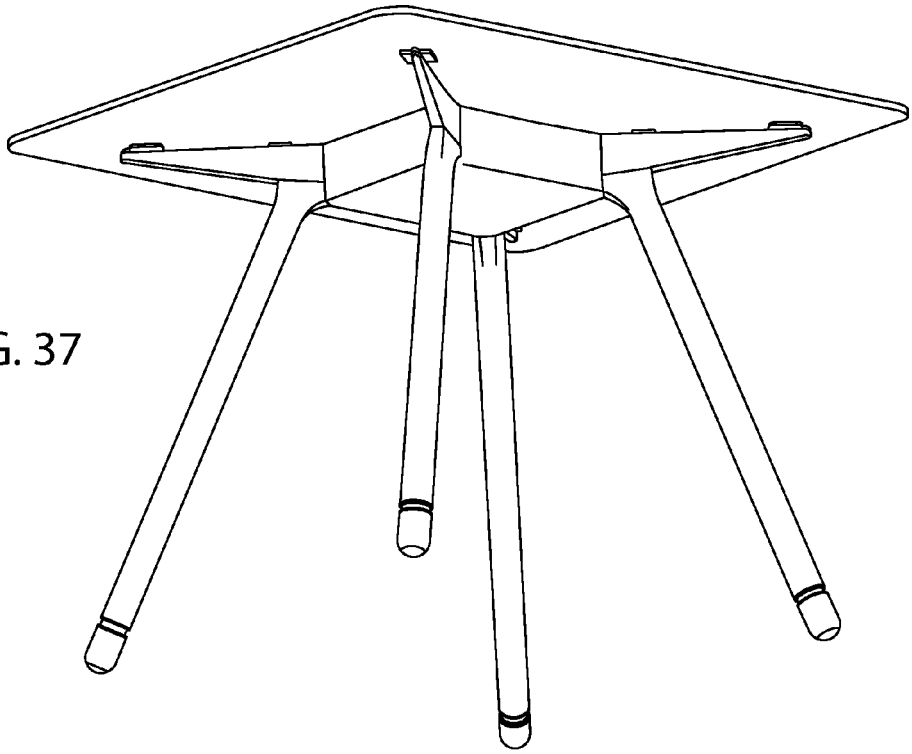
FIG. 37 is a bottom perspective view of the table construction of FIG. 36.
Figure 38:
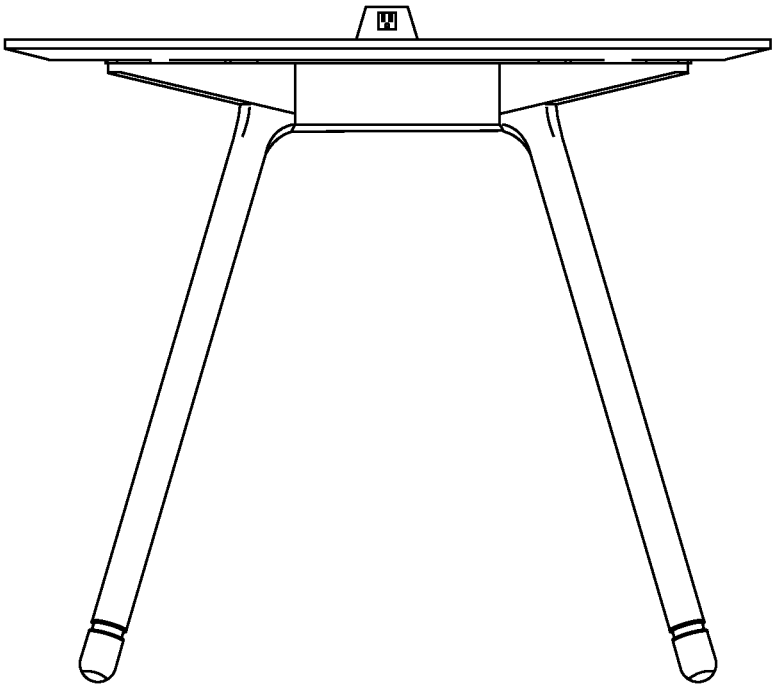
FIG. 38 is a side elevational view of the table construction of FIG. 36.
Figure 39:
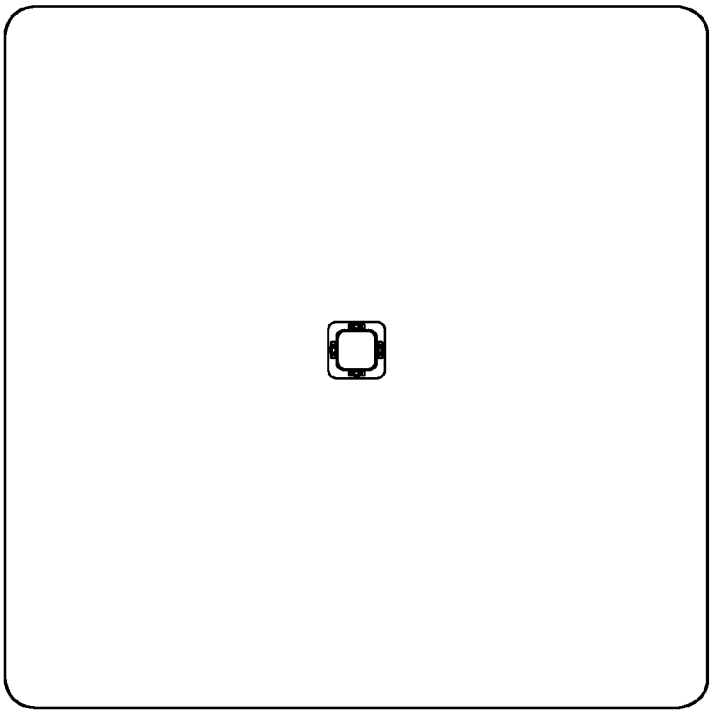
FIG. 39 is a top plan view of the table construction of FIG. 36.
Figure 40:
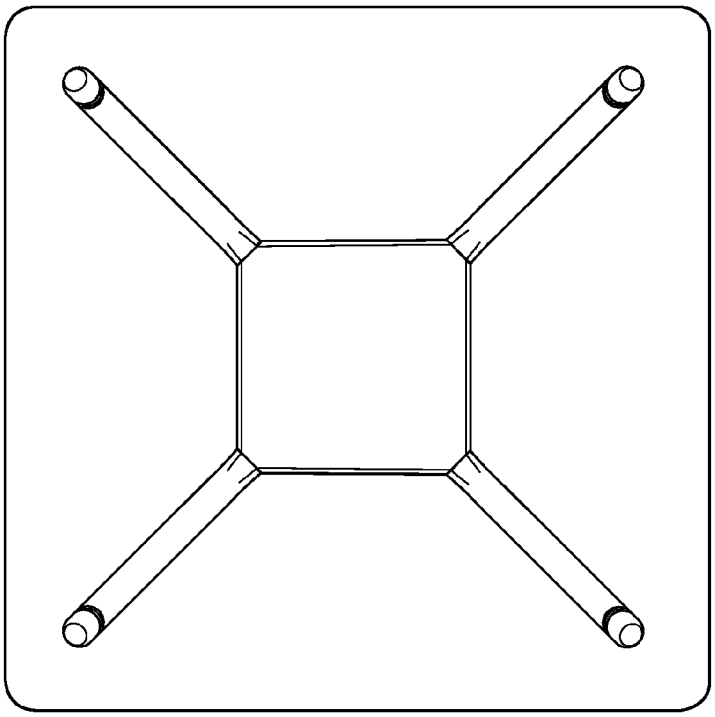
FIG. 40 is a bottom plan view of the table construction of FIG. 36.
Figure 41:
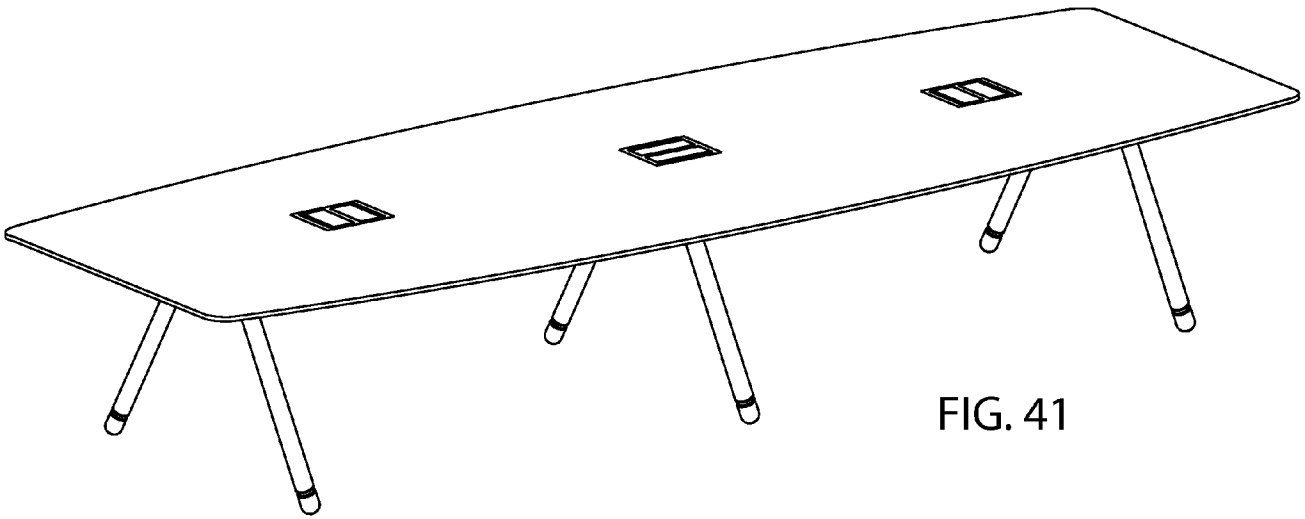
FIG. 41 is a top perspective view of a table construction.
Figure 42:
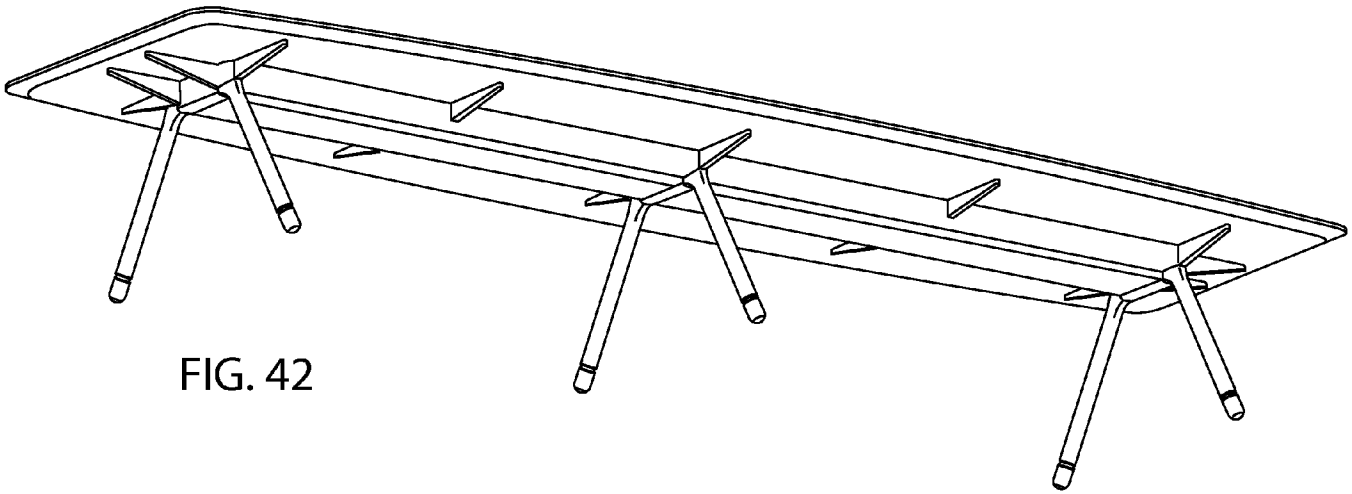
FIG. 42 is a bottom perspective view of the table construction of FIG. 41.
Figure 43:
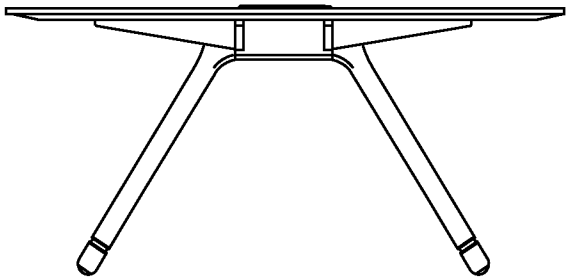
FIG. 43 is an end elevational view of the table construction of FIG. 41.
Figure 44:
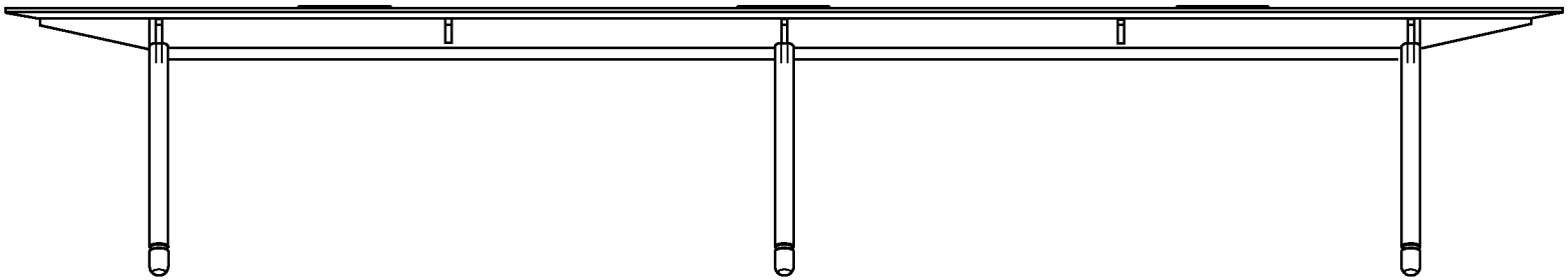
FIG. 44 is a side elevational view of the table construction of FIG. 41.
Figure 45:
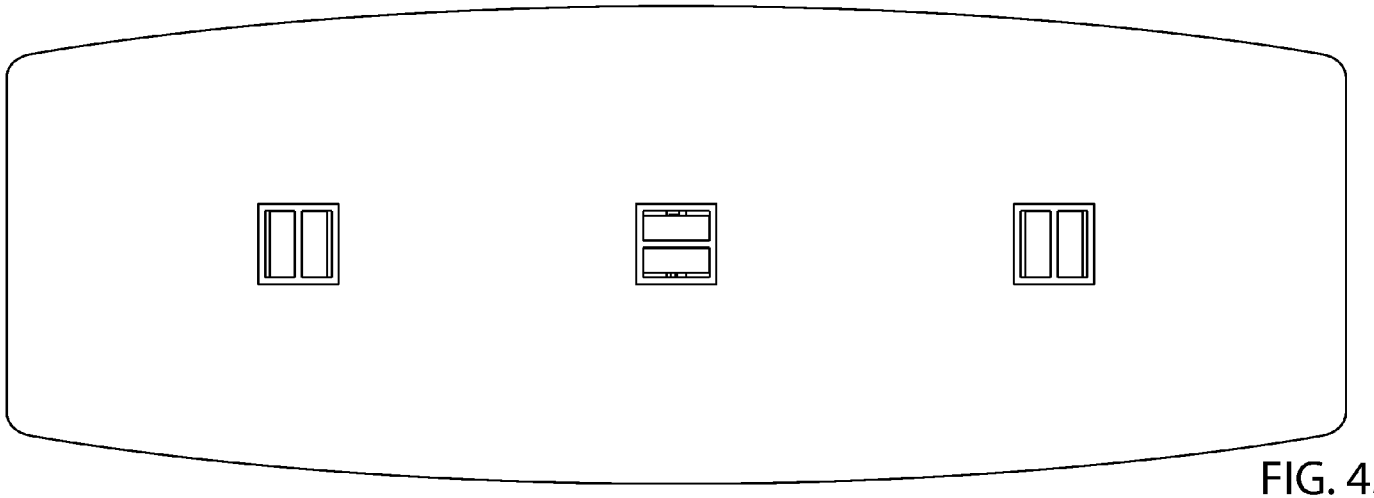
FIG. 45 is a top plan view of the table construction of FIG. 41.
Figure 46:
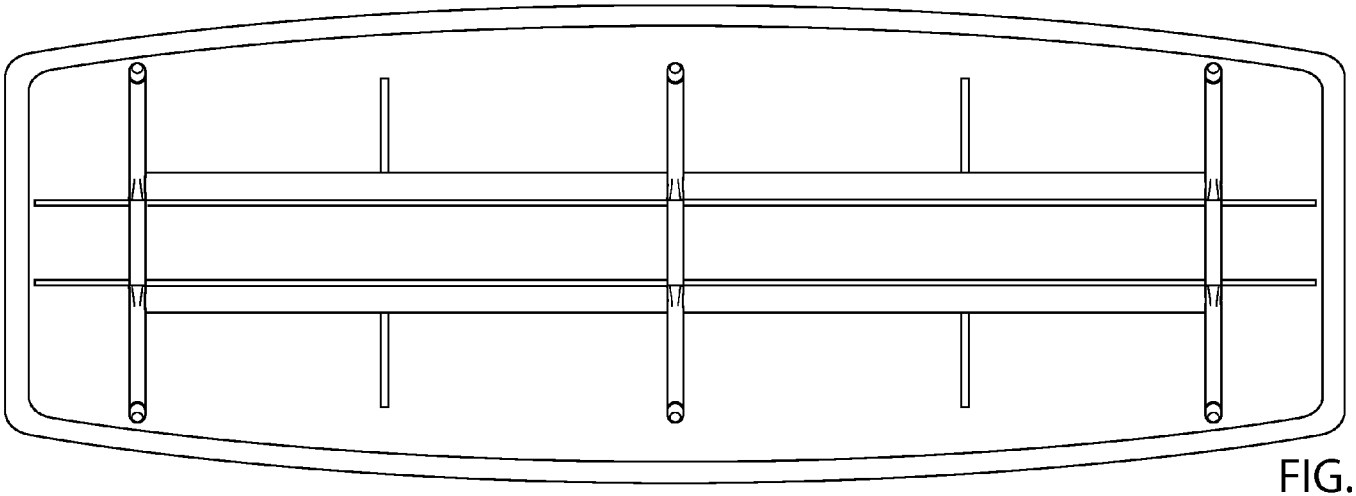
FIG. 46 is a bottom plan view of the table construction of FIG. 41.
Figure 47:
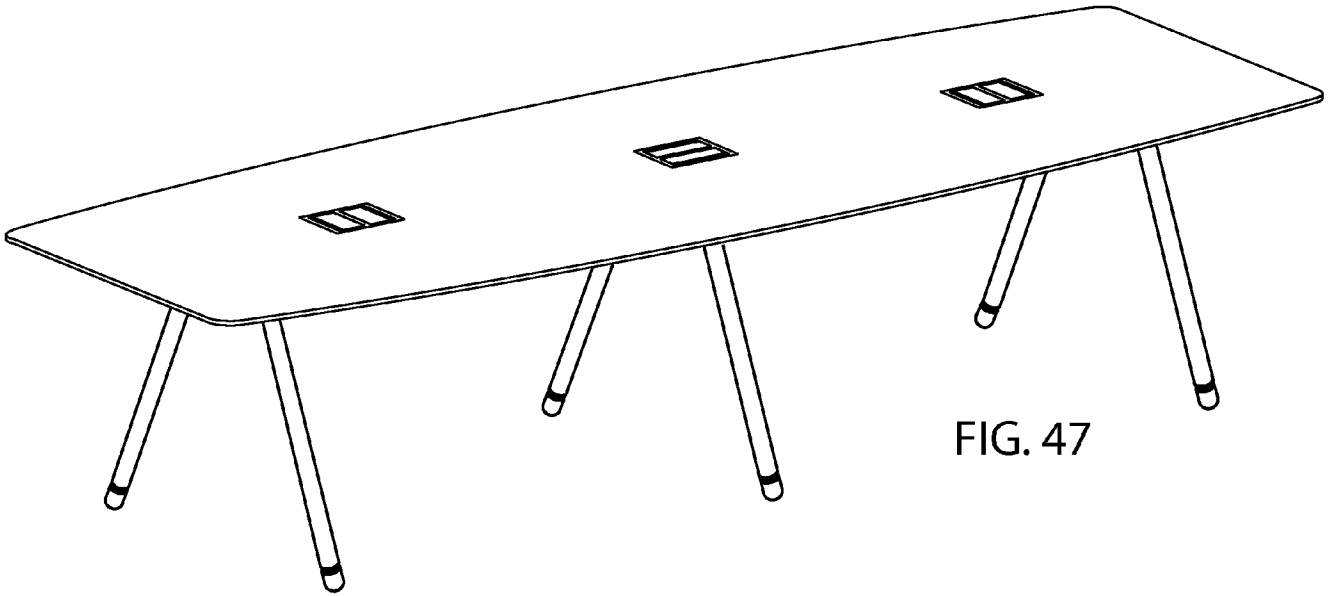
FIG. 47 is a top perspective view of a table construction.

With further reference to FIG. 6A, the base member 159 is shown in a raised position R relative to the body portion 152 of the leg assembly 150, thereby resulting in the shortest overall length of the leg assembly 150 and lowest elevation of a corresponding portion of a support worksurface. Referring now to FIG. 8, the base member 159 is shown in a lowered position L relative to the body portion 152 of the leg assembly 150, thereby resulting in an increase to the overall length of the leg assembly 150 and a raising of a corresponding portion of a support worksurface. The adjustment mechanism 190 is used to move the base member 159 between the raised and lowered positions R, L by rotating the base member 159 in a direction as indicated by arrow 212. In this way, the base member 159 can be quickly adjusted in a direction indicated by arrow 214 between the raised and lowered positions R, L, or any position therebetween, by a user without the need for outside adjusting tools in an office environment or other like setting. Further, the collar members 192, 193 telescope with respect to one another, thereby aesthetically filling the gap created between the end wall 194 of the body portion 150 and the base member 159. A user may adjust various legs to positions at or between R, L to ensure a work surface is level or at a desired incline.

A variant of table construction embodiments are illustrated in a variety of views, including: a sitting-height, rectangularly-shaped table construction shown in FIGS. 9-14; a standing-height, rectangularly-shaped table construction shown in FIGS. 15-20; a sitting-height, circularly-shaped table construction shown in FIGS. 21-25; a standing-height, circularly-shaped table construction shown in FIGS. 26-30; a sitting-height, square-shaped table construction shown in FIGS. 31-35; a standing-height, square-shaped table construction shown in FIGS. 36-40; a sitting-height, oblong table construction shown in FIGS. 41-46; a standing-height, oblong table construction shown in FIGS. 47-52; a sitting-height, rectangularly-shaped table construction shown in FIGS. 53-58; a standing-height, rectangularly-shaped table construction shown in FIGS. 59-64; and, a table construction shown in FIGS. 65-70. An embodiment of a table leg assembly is shown in FIGS. 71-77. It is noted that the electrical/communication unit shown positioned above the work surface of the various embodiments illustrated in FIGS. 9-70 may be placed at any position along the length of the associated work surface.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the invention as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, in some embodiments elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. In certain embodiments, the position of one or more legs may be modified with respect to the table beams and/or a worksurface by utilizing additional, additive structural pieces, which in certain instances position the legs closer to an edge of the worksurface. In other embodiments, various accessories may be created to attach to the legs, worksurface, and/or other elements of the table.

It will be understood by one having ordinary skill in the art that construction of the described invention and other components is not limited to any specific material. In some embodiments, materials may be selected for a particular application, for example, certain materials may be selected for an indoor application and other materials may be selected for an outdoor application. Other exemplary embodiments of the invention disclosed herein may be may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present invention. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

The invention claimed is:

1. A leg assembly for a table, comprising:

an elongated body portion having a wireway extending along a length of the body portion and configured to receive electrical power and communication lines therein;

one or more wire retaining assemblies located within the wireway of the body portion, each of the one or more wire retaining assemblies movable between a first position, wherein electrical power and communication lines are retained within the wireway, and a second position, wherein electrical power and communication lines may be readily removed from within the wireway, and wherein the one or more wire retaining assemblies is coupled to the body portion in the first position and the second position; and a cover member releasably connected to the one or more wire retaining assemblies.

2. The leg assembly of claim 1, wherein the one or more wire retaining assemblies includes a retainer bracket configured to abut electrical power and communication lines movable between the first and second positions.

3. The leg assembly of claim 2, wherein the retainer bracket is pivotably coupled to the body portion.

4. The leg assembly of claim 3, wherein the retainer bracket is pivotably coupled to a boss located within the wireway.

5. The leg assembly of claim 3, wherein the retainer bracket includes an aperture, and wherein the cover is coupled to the retainer bracket by a mechanical fastener received within the apertures.

6. The leg assembly of claim 1, wherein the cover member cooperates with the body portion to form at least one aperture for wire routing out of the wireway when the cover is connected to the body portion.

7. The leg assembly of claim 1, further comprising:

a base member assembly adjustably coupled to the body member such that adjustment of the base member assembly with respect to the body member increases or decreases a length of the leg assembly.

8. A table assembly comprising the leg assembly of claim 1.

9. A leg assembly for a table, comprising:

a body portion having a first end and a second end, the second end having an outer cross-sectional configuration, and an outer cross-sectional area;

a base member assembly configured to abut a floor surface and having an outer cross-sectional configuration substantially the same as the outer cross-sectional configuration of the second end of the body member, and an outer cross-sectional area substantially the same as the outer cross-sectional area of the second end of the body member; and an adjustment mechanism coupling the base member to the second end of the body portion, such that pivoting the base member with respect to the body member increases or decreases a length of the leg assembly.

10. The leg assembly of claim 9, wherein the adjustment mechanism includes a threaded shaft threadably connected to at least one of the body portion and the base member assembly.

11. The leg assembly of claim 10, wherein the threaded shaft is fixed with respect to the body portion.

12. The leg assembly of claim 9, wherein the adjustment mechanism includes at least one collar member configured to cover a gap created between the body portion and the base member assembly as a length of the leg assembly is increased.

13. The leg assembly of claim 12, wherein the at least one collar member includes a pair of collar members telescopingly engaging one another.

14. The leg assembly of claim 9, wherein the body portion includes a longitudinally-extending wireway configured for routing electrical power and communication lines therethrough.

15. The leg assembly of claim 9, further comprising:

a cover member releasably connected to the body portion so as to cover the wireway.

16. The leg assembly of claim 15, wherein the cover member cooperates with the body portion to form at least one aperture for wire routing out of the wireway when the cover is connected to the body portion.

17. The leg assembly of claim 15, further comprising:

at least one wire retaining assembly located within the wireway and configured to retain electrical power and communication lines, and wherein the cover member is releasably attached to the at least one wire retaining assembly.

18. The leg assembly of claim 9, wherein the base member assembly further includes a ground abutting plug member removably coupled to the base member.

19. A table assembly comprising the leg assembly of claim 9.

20. A leg assembly for a table, comprising:

a body portion having an upper end and a lower end;

a base member assembly adjustably coupled to the lower end of the body portion and configured to abut a floor surface, wherein adjustment of the base member assembly increases or decreases a length of the leg assembly, wherein the base member has an outer cross-sectional configuration substantially the same as an outer cross-sectional configuration of the second end of the body member and an outer cross-sectional area substantially the same as an outer cross-sectional area of the second end of the body member;

a wireway extending longitudinally along an interior of the body portion and configured for routing electrical power and communication lines therethrough; and a cover member releasably connected to the body portion so as to cover the wireway.

21. The leg assembly of claim 20, wherein the cover cooperates with the body portion to form at least one aperture for wire routing out of the wireway when the cover is connected to the body portion.

22. The leg assembly of claim 20, further comprising:

at least one wire retaining assembly located within the wireway and configured to retain electrical power and communication lines within the wireway.

23. The leg assembly of claim 20, wherein the cover member is attached to the at least one wire retaining assembly.

24. The leg assembly of claim 20, wherein the base member assembly includes a base member that is threadably coupled to the body portion.

25. The leg assembly of claim 20, wherein the base member assembly further includes a ground abutting plug member removably coupled to the base member.

26. A table assembly comprising a leg assembly of claim 20.

27. A leg assembly for a table, comprising:

a body portion having a first end and a second end;

a base member assembly configured to abut a floor surface; and an adjustment mechanism coupling the base member to the second end of the body portion such that a distance between the base member and the body portion may be adjusted thereby adjusting a length of the leg assembly, wherein the adjustment assembly includes at least one collar member extending between the body portion and the base member and configured to cover at least a portion of a gap formed between the base portion and the body portion as the distance between the base portion and the body portion increases, and wherein collar member includes a visual indicator configured to provide a visual indication of the amount of adjustment between the base member and the body portion so as to prevent an operator from exceeding a predetermined amount of adjustment.

28. The leg assembly of claim 27, wherein the visual indicator includes an element located along a length of the collar member.

29. The leg assembly of claim 27, wherein the visual indicator is an end of the collar member.

30. The leg assembly of claim 27, wherein the collar member is one of a pair of collar members that telescopingly engage one another.

31. A table assembly comprising the leg assembly of claim 27.

* * * * *